US011506019B2

(12) United States Patent
Killie et al.

(10) Patent No.: US 11,506,019 B2
(45) Date of Patent: Nov. 22, 2022

(54) VALVE FOR CLOSING FLUID COMMUNICATION BETWEEN A WELL AND A PRODUCTION STRING, AND A METHOD OF USING THE VALVE

(71) Applicant: Innowell Solutions AS, Porsgrunn (NO)

(72) Inventors: Rune Killie, Skien (NO); Trygve Rinde, Porsgrunn (NO)

(73) Assignee: Innowell Solutions AS, Porsgrunn (NO)

( * ) Notice: Subject to any disclaimer, the term of this patent is extended or adjusted under 35 U.S.C. 154(b) by 67 days.

(21) Appl. No.: 17/263,002

(22) PCT Filed: Aug. 16, 2019

(86) PCT No.: PCT/NO2019/050167
§ 371 (c)(1),
(2) Date: Jan. 25, 2021

(87) PCT Pub. No.: WO2020/046135
PCT Pub. Date: Mar. 5, 2020

(65) Prior Publication Data

US 2021/0172285 A1 Jun. 10, 2021

(30) Foreign Application Priority Data

Aug. 27, 2018 (NO) ..... 20181120

(51) Int. Cl.
*E21B 34/08* (2006.01)
*E21B 43/12* (2006.01)
*E21B 43/14* (2006.01)

(52) U.S. Cl.
CPC ..... *E21B 34/08* (2013.01); *E21B 43/12* (2013.01); *E21B 43/14* (2013.01)

(58) Field of Classification Search
CPC ..... E21B 43/12; E21B 34/08; E21B 43/14
See application file for complete search history.

(56) References Cited

U.S. PATENT DOCUMENTS 8,833,466 B2 * 9/2014 Zhou ..... E21B 43/14 166/369
2007/0246407 A1 10/2007 Richards et al.
(Continued)

FOREIGN PATENT DOCUMENTS

NO 20161700 3/2018
NO 201601700 A * 3/2018 ..... E21B 34/08
(Continued)

OTHER PUBLICATIONS

Norwegian Search Report for NO20181120, dated Mar. 26, 2019.
(Continued)

*Primary Examiner* — Aaron L Lembo
(74) *Attorney, Agent, or Firm* — Andrus Intellectual Property Law, LLP

(57) ABSTRACT

A valve is for closing fluid communication between a horizontal or deviated well and a production string when a content of a first or a second undesired fluid in the fluid flow exceeds a predetermined level. The valve has a primary flow channel, and a piston arrangement movable within the valve between an inactive position allowing fluid flow through the primary channel and an active position preventing fluid flow through the primary channel. The piston arrangement further has a secondary flow channel and a bypass flow channel and inflow control elements exposed to the fluid flow upstream of the flow barrier and having different density and movable within independent paths in response to a density of fluid.

10 Claims, 25 Drawing Sheets

(56) References Cited

U.S. PATENT DOCUMENTS

| | | | | |
|---|---|---|---|---|
| 2008/0041580 | A1 | 2/2008 | Freyer et al. | |
| 2008/0041581 | A1 | 2/2008 | Richards | |
| 2008/0041582 | A1 | 2/2008 | Saetre et al. | |
| 2009/0095512 | A1 | 4/2009 | Okahata et al. | |
| 2009/0151925 | A1 | 6/2009 | Richards et al. | |
| 2012/0211243 | A1* | 8/2012 | Dykstra | E21B 34/06 166/373 |
| 2013/0068467 | A1 | 3/2013 | Zhou | |
| 2015/0021019 | A1 | 1/2015 | Veit | |
| 2015/0060084 | A1 | 3/2015 | Moen et al. | |
| 2019/0264535 | A1* | 8/2019 | Killie | E21B 43/12 |
| 2021/0002978 | A1* | 1/2021 | Killie | E21B 34/08 |
| 2021/0172285 | A1* | 6/2021 | Killie | E21B 43/14 |

FOREIGN PATENT DOCUMENTS

| | | | |
|---|---|---|---|
| NO | 20180230 | 8/2019 | |
| WO | 2011095512 | 8/2011 | |
| WO | 2013139601 | 9/2013 | |
| WO | 2014081306 | 5/2014 | |
| WO | 2015199545 | 12/2015 | |
| WO | 2016033459 | 3/2016 | |
| WO | 2018080313 | 5/2018 | |
| WO | WO-2019160423 A1 * | 8/2019 | E21B 34/08 |
| WO | WO-2020046135 A1 * | 3/2020 | E21B 34/08 |

OTHER PUBLICATIONS

International Search Report and the Written Opinion for PCT/NO2019/050167, dated Sep. 26, 2019.

Response to the Written Opinion for PCT/NO2019/050167, dated May 13, 2020.

The Written Opinion for PCT/NO2019/050167, dated Jun. 15, 2020.

The International Preliminary Report on Patentability for PCT/NO2019/050167, dated Oct. 26, 2020.

* cited by examiner

Single-phase oil

Oil to water (before closing)

Single-phase water (closed)

Water to oil (before reopening)

Single-phase oil

Oil to gas (before closing)

Single-phase gas (closed)

Gas to oil (before reopening)

T–T

VALVE FOR CLOSING FLUID COMMUNICATION BETWEEN A WELL AND A PRODUCTION STRING, AND A METHOD OF USING THE VALVE

CROSS-REFERENCE TO RELATED APPLICATIONS

This application is the U.S. national stage application of International Application PCT/NO2019/050167, filed Aug. 16, 2019, which international application was published on Mar. 5, 2020, as International Publication WO 2020/046135 in the English language. The International Application claims priority of Norwegian Patent Application No. 20181120, filed Aug. 27, 2018. The international application and Norwegian application are both incorporated herein by reference, in entirety.

FIELD

The present invention relates to a valve, and a method of using the valve in a horizontal or deviated well. More particularly, the valve according to the invention may be used for closing inflow of undesired fluids exceeding a predetermined level that may be drained from a reservoir surrounding the well. In a petroleum producing well the fluids may typically be drained into a production string. In this document the term "level" means volume fraction of undesired fluid.

BACKGROUND

In an oil-producing well the undesired fluids might typically be gas or water. A person skilled in the art will appreciate that fluids regarded as desired or undesired will vary depending on the purpose of the well and the operational scenario.

Thus, one purpose of the invention is to control the inflow of various fluids that may be drained from a reservoir. In a well for producing oil such fluids may be one or more of oil, gas, and water which is drained from the reservoir.

The valve according to the invention is configured to discriminate between desired and undesired fluids when the undesired fluid exceeds a predetermined level. The invention may provide an autonomous inflow control device (AICD). A plurality of AICDs may be distributed along a reservoir section of a well to block or restrict inflow of undesired fluids from the reservoir, typically water and gas.

Today, AICDs commonly used in the petroleum exploration industry are configured in such a way that they distinguish between unwanted fluids (normally gas or water) and wanted fluids (normally oil) based on differences in fluid viscosity. This results in different Re (Reynolds number—a dimensionless number that gives a measure of the ratio of inertial forces to viscous forces for given flow conditions) and therefore different flow characteristics, e.g. different pressure drop across a hydraulic restriction. These differences are then transformed into a force that controls the opening and closing of the AICD.

However, differences in Reynolds number are not necessarily caused by different viscosities. It can also be caused by differences in velocity. In a heterogeneous reservoir with large variations in permeabilities and local inflow rates along the reservoir, the velocity and therefore the Reynolds number can be very different in different AICDs along the reservoir. This becomes even more challenging if the objective is to distinguish between two fluids that only have a small difference in viscosity, like water and light oil.

The effective viscosity of a two-phase mixture (oil-gas or oil-water) is dominated by the viscosity of the continuous phase. This means that the effective viscosity of the mixture varies significantly near the inversion point (typically around 50% volume fraction), but not so much when approaching the one-phase limit (pure gas or pure water). It is often desirable to block or restrict the unwanted fluid only when its volume fraction approaches a high value close to 100%, for example 90%, but this will be challenging for AICDs based on viscosity differences as the effective viscosity of the mixture is practically insensitive to the volume fraction at high volume fractions.

Publication US2008041581 A1 discloses a fluid flow control apparatus for controlling the inflow of production fluids from a subterranean well. The apparatus includes a fluid discriminator section and a flow restrictor section that is configured in series with the fluid discriminator section such that fluid must pass through the fluid discriminator section prior to passing through the flow restrictor section. The fluid discriminator section comprises a plurality of free floating balls, each ball operable to autonomously restrict a hole and thereby at least a portion of an undesired fluid type, such as water or gas, from the production fluids. The flow restrictor section is operable to restrict the flow rate of the production fluids, thereby minimizing the pressure drop across the fluid discriminator section.

The publication US2007246407 discloses inflow control devices for sand control screens. A well screen includes a filter portion and at least two flow restrictors configured in series, so that fluid which flows through the filter portion must flow through each of the flow restrictors. At least two tubular flow restrictors may be configured in series, with the flow restrictors being positioned so that fluid which flows through the filter portion must reverse direction twice to flow between the flow restrictors. US2007246407 also discloses a method of installing a well screen wherein the method includes the step of accessing a flow restrictor by removing a portion of an inflow control device of the screen. US2007246407 suggests a plurality of free-floating balls in annular chambers. If the fluid flowing through the chamber has the same density as the balls, the balls will start to flow along with the fluid. Unless a ball is trapped inside a recirculation zone, it will eventually be carried to an exit hole, which it blocks. Suction force will cause the ball to block the hole continuously until production is stopped. A production stop will cause pressure equalization, such that the ball can float away from the hole. The free-floating balls block a main flow passage.

Publication US20080041580 discloses an apparatus for use in a subterranean well wherein fluid is produced which includes both oil and gas. The apparatus comprises: multiple first flow blocking members, each of the first members having a density less than that of the oil, and the first members being positioned within a chamber so that the first members increasingly restrict a flow of the gas out of the chamber through multiple first outlets. The flow blocking members block a main flow passage.

Publications US2008041582 discloses an apparatus which is based on the same principles as US20080041580 mentioned above.

Publication US20130068467 discloses an inflow control device for controlling fluid flow from a subsurface fluid reservoir into a production tubing string, the inflow control device comprising:

a tubular member defining a central bore having an axis, wherein upstream and downstream ends of the tubular member may couple to the production tubing string; a plurality of passages formed in a wall of the tubular member; an upstream inlet to the plurality of passages leading to an exterior of the tubular member to accept fluid; each passage having at least two flow restrictors with floatation elements of selected and different densities to restrict flow through the flow restrictors in response to a density of the fluid; at least one pressure drop device positioned within each passage in fluid communication with an outflow of the flow restrictors, the pressure drop device having a pressure piston for creating a pressure differential in the flowing fluid based on the reservoir fluid pressure; and wherein an outflow of the pressure drop device flows into an inflow fluid port in communication with the central bore.

Publication WO2014081306 discloses an apparatus and a method for controlling fluid flow in or into a well. The apparatus includes at least one housing having an inlet and at least one outlet, one of which is arranged in a top portion or a bottom portion of the housing when in a position of use, and a flow control means disposed within the housing. The flow control means has a density that is higher or lower than a density of a fluid to be controlled and a form adapted to substantially block the outlet of the housing when the flow control means is in a position abutting the outlet.

In the prior art apparatuses referred above, the unwanted fluid, such as gas or water, is blocked by means of flow control elements arranged in a main flow path. Thus, it is difficult for the apparatus to control where an interface of the wanted and unwanted fluid is located.

Publications US20150060084 A1 and WO2016033459 A1 disclose a flow control device to improve a well operation, such as a production operation. A flow control device has a valve positioned in a housing for movement between flow positions. The different flow positions allow different levels of flow through a primary flow port. At least one flow regulation element is used in cooperation with and in series with the valve to establish a differential pressure acting on the valve. The differential pressure is a function of fluid properties and is used to autonomously actuate the flow control device to an improved flow position. Different fluids with different viscosities or Reynolds numbers have different flow characteristics and pressure drop through the secondary flow path, which means that the piston can open for wanted fluid and close for unwanted fluid.

Publication NO20161700 discloses an apparatus and a method for controlling a fluid flow in, into or out of a well, the apparatus comprising: a main flow channel having an inlet and an outlet being in fluid communication with the fluid flow; at least one chamber arranged in fluid communication with the main flow channel, the chamber having at least one flow control element movable between a first non-blocking position and a second blocking position for the fluid flow between the inlet and the outlet of the main flow channel, the flow control element movable in response to density of fluid in said chamber. The main flow channel is provided with pressure changing means causing a pressure differential in a fluid return conduit providing fluid communication between said chamber and a portion of the main flow channel, so that fluid in said chamber is recirculated back to the main flow channel when the main flow channel is open, and an orientation means for orienting the apparatus in the well. NO20161700 suggests ejectors to remove accumulations of undesired fluids, such that the valve will close at higher volume fractions of unwanted fluids. The apparatus and method disclosed in NO20161700 has proven to function satisfactorily. The flow control elements are configured to operate in a main flow path through the apparatus, and the drag forces acting on the flow control elements are thus sensitive inter alia to Reynolds number.

Unpublished patent application NO 20180230 to the applicant discloses a valve suitable for closing fluid communication between a well and a production string when a content of an undesired fluid in the fluid flow exceeds a predetermined level, the valve comprising:

- a primary flow channel having a primary inlet through a flow barrier, and a low pressure portion;
- a secondary flow channel connected to the primary flow channel at the low pressure portion, the secondary flow channel having a secondary inlet through the flow barrier and provided with a flow restrictor;
- a chamber in connection with the secondary flow channel;
- a piston arranged in the primary flow channel for opening and closing the primary flow channel, the piston defining a portion of the chamber in connection with the secondary flow channel;
- an inflow control element responsive to a density of a fluid;

wherein the inflow control element is exposed to the fluid flow upstream of the flow barrier and is arranged to close the secondary inlet when the content of the undesired fluid in the flow upstream of the flow barrier exceeds the predetermined level; and wherein the closing of the secondary inlet causes an underpressure in the chamber such that the piston is activated and the valve is closed.

The valve of NO 20180230 operates independently of fluid viscosity, local velocity and Reynolds number, and is also capable of reliably blocking or restricting the unwanted fluid for all flow rates once the volume fraction of the unwanted fluid exceeds a pre-defined limit. The valve operates satisfactorily according to its intention. However, the valve of NO 20180230 must be configured to close for either a first undesired fluid having a first density or a second undesired fluid having a density being different from the density of the first fluid. The first undesired fluid may typically be gas, while the second undesired fluid may typically be water. The desired fluid may typically be oil.

A well, such as a long-reach horizontal oil producing well may drain undesired fluids such as water and gas along its length. Therefore, there is a need for a valve that is configured for substantially blocking inflow of both water and gas when the content thereof exceeds a predetermined level.

SUMMARY

The invention has for its object to remedy or to reduce at least one of the drawbacks of the prior art, or at least to provide a useful alternative to prior art.

The object is achieved through features, which are specified in the description below and in the claims that follow.

The invention is defined by the independent patent claims. The dependent claims define advantageous embodiments of the invention.

In a first aspect of the invention there is provided a valve for closing fluid communication between a horizontal or deviated well and a production string when a content of a first or a second undesired fluid in the fluid flow exceeds a predetermined level, the valve comprising:

- a primary flow channel having a primary inlet through a flow barrier and a primary outlet;
- a piston arrangement movable within the valve between an inactive position allowing fluid flow through the primary flow channel and an active position preventing fluid flow through the primary flow channel, the piston arrangement comprising:

a secondary flow channel having two separate flow paths, wherein each flow path has an inlet through the flow barrier and in connection with the primary flow channel;

a bypass flow channel having two inlets through the flow barrier, and a bypass flow channel outlet, the valve further comprising two inflow control elements exposed to the fluid flow upstream of the flow barrier and having different density and being movable within two independent paths between the respective inlets in response to a density of fluid, wherein a first of the two inflow control elements has a density between a density of the desired fluid and the density of a first undesired fluid, and a second of the two inflow control elements has a density between the density of the desired fluid and the density of a second undesired fluid;

wherein the secondary flow channel is open and the bypass flow channel is closed when an amount of undesired fluid is below the predetermined level, and the piston arrangement is in the inactive position, and said opening and closing causing a change in pressure balance within the piston arrangement thereby moving the piston arrangement to the active position wherein the primary flow channel is closed.

Each flow path of the secondary flow channel may be configured for providing a pressure towards the inactive position of the piston arrangement when fluid flows through the secondary flow channel.

The bypass flow channel may be configured for providing a pressure towards the active position of the piston arrangement when fluid flows through the bypass flow channel.

Preferably, the primary flow channel is provided with a low pressure portion. By the term "low pressure portion" is meant a portion of the primary flow channel wherein the pressure of a flowing fluid is lower than the fluid pressure upstream of the barrier. One purpose of the low pressure portion is to provide a pressure differential required to move the piston.

The purpose of the two separate flow paths of the secondary flow channel is inter alia to make possible a design wherein the fluid fractions of the first and second undesired fluids at which the valve closes, may be different. For simplicity, the secondary flow channel with the two separate flow paths will hereinafter be denoted secondary flow channel.

The density of the inflow control elements is adapted to the density of each of the undesired fluids. Therefore, the density of the two inflow control elements is different. As mentioned above, a first of the two inflow control elements has a density between a density of the desired fluid and the density of a first undesired fluid, and a second of the two inflow control elements has a density between the desired fluid and the density of a second undesired fluid.

If the valve is utilized in an oil producing well the desired fluid is oil and the undesired fluids are water and gas. In such an embodiment, the first of the two inflow control elements has a density between that of oil and gas, and the second of the two inflow control elements has a density between that of oil and water.

The density of gas is at an in situ condition. By in situ condition is meant reservoir pressure and temperature.

Thus, the position of the piston arrangement depends on whether fluid is flowing into both inlets of the secondary flow channel or if one of the inlets of the secondary flow channel is blocked by one of the two inflow control elements. Whether or not fluid is flowing into both inlets of the secondary flow channel depends on the content, or volume fraction, of the undesired fluid in the flow upstream of the barrier and a position of the inflow control elements with respect to the secondary inlet. By the term upstream is meant fluid "abutting" or being adjacent to the barrier.

The operation of the valve according to the invention depends on the density of the fluid flow upstream of the flow barrier only, and is thus independent of fluid viscosity, velocity of the flowing fluid and Reynolds number.

The predetermined level of undesired fluid may be set by means of a hydraulic resistance of the secondary flow channel relative to the primary flow channel, i.e. a configuration of the valve.

In one embodiment, the primary inlet is provided with an inlet tube having at least one tube inlet which, in a position of use, is arranged at a first elevation, and wherein one of the inlets of the secondary flow channel and the bypass flow channel are arranged at a second elevation, and the other of the inlets of the secondary flow channel and the bypass flow channel are arranged at a third elevation, the first elevation being between the second and third elevation. This has an effect of allowing a closing of the valve for both the first and second undesired fluids, such as for example gas in one situation and water in another situation.

The piston arrangement may be axially movable within a portion of an annulus defined by:

an inner tubular body for being in fluid communication with the production string;

a housing arranged coaxially with and surrounding a portion of the inner tubular body;

a downstream barrier arranged within the annulus and axially spaced apart from the flow barrier;

wherein the annulus further comprises a stationary valve seat arranged between the downstream barrier and the flow barrier so that a portion of the piston arrangement abuts the valve seat when the piston arrangement is in its active or closed position, and the piston arrangement does not abut the valve seat when the piston arrangement is in its inactive or open position.

In such an embodiment, the valve seat may comprise a first valve seat element and a second valve seat element axially spaced apart from the first valve seat element, a portion of the piston arrangement being movable between the valve seat elements, said portion abutting both valve seat elements when the piston arrangement is in its active or closed position. As will be explained in more details below, the piston arrangement is preferably provided with a leakage means for allowing a small leakage through the valve when in a closed position so that the valve is capable of reopening when an amount of undesired fluid decreases below the predetermined level.

In one embodiment the valve is provided with at least one leakage channel being in fluid communication with the bypass flow channel outlet for allowing leakage through the valve when the piston arrangement is in its active or closed position. The leakage channel extends through the upstream barrier. Thus, both the leakage channel and the second and fourth piston chambers are in fluid communication with the bypass flow channel outlet.

Preferably, the at least one leakage channel is provided with a venturi at which the flow channels from the second and fourth piston chambers are connected.

The at least one leakage channel may comprise a first leakage channel and a second leakage channel being in fluid communication with the first leakage channel by means of a conduit.

Such a second leakage channel may also be in fluid communication with the bypass channel outlet, preferably at the venturi of the leakage channel discussed above. In a position of use, the second leakage channel is typically arranged below the primary inlet of the primary flow channel.

The bypass flow channel outlet may be closable by a bypass flow channel closing element forming part of the piston arrangement. Such a bypass flow channel outlet is typically closed when the primary flow channel is open, i.e. when the piston arrangement is in its inactive position.

One of the at least one leakage channel may, in a position of use of the valve, be arranged at a top portion of the flow barrier.

The valve may further be provided with a pressure-controlled mechanism for providing a pressure differential across a portion of the piston arrangement when the piston arrangement abuts the valve seat, the pressure controlled mechanism being responsive to a difference in fluid pressure upstream and downstream of the valve so that a closing force of the valve is added to the piston arrangement when said difference in fluid pressure is positive.

The piston arrangement may comprise a first piston for defining a first piston chamber and a second piston chamber, and a second piston for defining a third piston chamber and a fourth piston chamber. In such an embodiment the first and second pistons are interconnected by a connection means. The purpose of the connection means is to provide a synchronous movement of the two pistons when the piston arrangement is subject to a change in pressure balance.

It should be noted the forces acting on the piston in different modes, i.e. valve open, valve closed, valve closing and valve reopening, can be optimized by adjusting the areas of the four piston surfaces of the two pistons along with other surfaces in the piston arrangement.

In what follows, the two inlets of the secondary flow channel are denoted a secondary flow channel first inlet and a secondary flow channel second inlet. Likewise, the two inlets of the bypass flow channel are denoted bypass flow channel first inlet and bypass flow channel second inlet.

In one embodiment, the secondary flow channel first inlet may be in fluid communication with the first piston chamber;

the secondary flow channel second inlet may be in fluid communication with the third piston chamber, the first piston chamber and the third piston chamber may be in fluid communication with the primary flow channel;

a bypass flow channel first inlet and a bypass flow channel second inlet may be in fluid communication with the second piston chamber and the fourth piston chamber, and wherein the second piston chamber and the fourth piston chamber may be in fluid communication with the bypass flow channel outlet.

The piston chambers may be annular piston chambers.

Thus, the secondary flow channel first inlet, the first piston chamber and a communication channel from the first piston chamber to the primary flow channel may form one of the two separate flow paths of the secondary flow channel. Similarly, the secondary flow channel second inlet, the third piston chamber and a communication channel from the third piston chamber to the primary flow channel may form the other one of the two separate flow paths of the secondary flow channel.

The communication channel from the first piston chamber to the primary flow channel may be independent of the communication channel from the third piston chamber to the primary flow channel.

In an embodiment wherein the first piston chamber and the third piston chamber are in fluid communication with the primary flow channel, a connection between the secondary flow channel and the primary flow channel will also be denoted "pilot hole". In one embodiment, the pilot hole is arranged at a vena contracta of the primary flow channel. When fluid is flowing through the primary flow channel, a fluid pressure at the outlet of the pilot hole will then be lower than the fluid pressure at the secondary flow channel first and second inlets through the flow barrier, i.e. in the fluid upstream of the barrier.

The hydraulic resistance depends inter alia on a configuration of the pilot hole providing the connection between the secondary flow channel and the primary flow channel.

Preferably, a pressure drop through the secondary flow channel inlets is smaller than a pressuredrop through the pilot hole. Preferably, the pilot hole is designed so that a discharge coefficient (effective flow area divided by the physical flow area) is substantially independent of the Reynolds number.

The secondary flow channel first inlet may, in the position of use, be arranged at a first elevation, and the secondary flow channel second inlet may be arranged at a second elevation that is different from the first elevation.

Similarly, the bypass channel first inlet may, in the position of use, be arranged at a first elevation, and the bypass flow channel second inlet may be arranged at a second elevation that is different from the first elevation.

In a position of use, the secondary flow channel first inlet may be arranged at the same elevation as the bypass channel first inlet, and the secondary flow channel second inlet may be arranged at the same elevation as the bypass channel second inlet.

As mentioned above, the inflow control elements may be float elements movable in different paths, each of the paths extending between a first position and a second position, wherein each of the inflow control elements in the first position is configured to block one of the two inlets, and in the second position is configured to block the other one of the two inlets. There are several advantages of providing such paths.

A first advantage is that the movement of each of the float elements is kept within defined limits. This has the effect that the float elements may be kept distant from the primary inlet for all flow regimes that may appear. The float elements will thus not be subject to a "mix-phase" that may appear at the primary inlet in the fluid flow upstream of the barrier. Further, the float element will not provide an obstruction to the fluid flowing into the primary inlet.

A second advantage is that the inlets of the secondary flow channel and the bypass flow channel may be arranged at desired elevations, and that the float elements can be prevented from moving beyond the desired elevations even if the fluid would otherwise move the float elements beyond the inlets.

The float elements may be a ball movable in a path constituted by a guide element, such as for example a cage arranged immediately upstream of the barrier. The float elements may typically be circular, but other shapes are also conceivable, such as non-circular, for example oblong, or discshaped, or polygonal.

In an alternative embodiment, the float elements may be pivotably connected to an upstream portion of the barrier. In an embodiment where the float elements are discs, such discs may be arranged in separate disk-channels forming part of the barrier itself. Such channels will then serve the same purpose as the path discussed above. The channels will be in constant fluid communication with the fluid flow upstream of the barrier so that the discs are exposed to the fluid flow upstream of the barrier.

Independent of the type of float elements utilized, each of the float elements must be capable of blocking one of the two inlets of the secondary flow channel and bypass flow channel, respectively, when the content of the undesired fluid in the fluid flow upstream of the barrier exceeds the predetermined level.

Preferably, the primary flow channel is substantially a continuation of the flow upstream of the barrier.

When the valve is in its inactive or open position, the primary flow channel provides fluid communication between the primary inlet and an outlet for providing fluid communication with a fluid flowing in the inner tubular body wherein the tubular body is in fluid communication with the production string as mentioned above. In what follows, the inner tubular body will also be denoted barrel.

In a basic configuration, the valve according to the invention has only three movable parts; the two float elements and the axially movable piston arrangement. This has the effect that the valve is very reliable.

The valve seat may comprise a first valve seat element and a second valve seat element axially spaced apart from the first valve seat element. In such an embodiment, a portion of the piston arrangement may be movable between the valve seat elements. Said portion of the piston arrangement is operatively connected to the rest of the piston arrangement, typically by means of one or more rods. When the valve is in its active or closed position, said portion of the piston arrangement may abut both valve seat elements. This configuration with two valve seat elements is particularly useful for providing an added closing force to the valve and for providing a re-opening mechanism as will be discussed below.

To provide an added closing force, the valve may be provided with a pressure-controlled mechanism for providing a pressure differential across a portion of the piston arrangement when said portion of the piston arrangement abuts the stationary valve seats, the pressure-controlled mechanism may be responsive to a difference in fluid pressure upstream and downstream of the valve so that a closing force of the valve is added to the piston arrangement when said difference in fluid pressure is positive.

The pressure-controlled mechanism may comprise an annular cavity formed between a portion of the piston arrangement and the second valve seat element when a portion of said piston arrangement abuts a downstream face of the second valve seat element, and pressure communication channel passing through the second valve seat element for communicating fluid from the primary inlet to an annulus formed between the second valve seat element and the first valve seat element when the valve is closed.

As mentioned above, the valve may be provided with a leakage means for allowing leakage through the valve when the valve is in a closed position.

In one embodiment, the leakage means may be an aperture extending through a portion of the second valve seat element, the aperture providing fluid communication through a portion of the piston arrangement and the first valve seat element. The purpose of such a leakage means is to provide a small leakage, typically in the range of 2-20% of a flow capacity of an inactive or open valve, through the valve so that the undesired fluid that caused the valve to initially close, is allowed to be "drained" and subsequently replaced by a desired fluid that may re-occur upstream of the barrier. Such a situation may occur if undesired fluid, for example water or gas in a near-wellbore region, retreats and is replaced by desired fluid, such as oil. Thus, the leakage means may form part of a re-opening mechanism.

The pressure-controlled mechanism may further comprise a first leakage channel and a second leakage channel for communicating fluid upstream of the flow barrier to the pressure-controlled mechanism. The first and second leakage channels may provide a pressure differential across a portion of the piston arrangement when the piston arrangement abuts the stationary valve seat, and the pressure-controlled mechanism may be responsive to a difference in fluid pressure upstream and downstream of the valve so that a closing force of the valve is added to the piston arrangement when said difference in fluid pressure is positive.

In a position of use, the first leakage channel and a possible second leakage channel, may be arranged at extreme levels with respect to primary inlet, the secondary flow channel inlets and the bypass channel inlets. Typically, the first leakage channel is arranged at a top portion of the valve, while the second inlet is arranged at a bottom portion of the valve.

As discussed above, the pressure-controlled mechanism may comprise an annular cavity formed between a portion of the piston arrangement and the second valve seat element when said portion of the piston arrangement abuts a downstream face of the second valve seat element.

The pressure-controlled mechanism may further comprise a pressure communication channel passing through the second valve seat element for communicating fluid from the primary inlet to an annulus formed between the second valve seat element and the first valve seat element when the valve is closed.

The first leakage channel and the second leakage channel may be merged or interconnected into one common channel prior to entering the pressure-controlled mechanism. A total leakage flow through a valve being in a closed position is thus controlled by the flow area of the common channel. Preferably, the flow area of the common channel is less than a sum of the flow area of the first leakage channel and the second leakage channel. The diameter ratio of the first leakage channel and the second leakage channel influences the fraction of the undesired fluid, for example water or gas, at which the valve will re-open from a closed position.

Preferably, the valve is designed to re-open at a fraction of undesired fluid that is significantly lower than a fraction of undesired fluid where the valve closes. This has the effect of at least reducing possibility of the valve continuously toggling between a closed position and an open position. By the term "significantly" is meant more than 5% difference.

In a second aspect of the invention, there is provided a completion string comprising the valve according to the first aspect of the invention.

In a third aspect of the invention, there is provided a method for controlling fluid flow in, into or out of a well. The method may comprise the steps of:

mounting a valve according to the first aspect of the invention as part of a well completion string prior to inserting the string in the well;

bringing the well completion string into the well;

orienting the valve within the well; and flowing fluid out of the well.

The orienting is necessary due to the fact that the function of the valve is dependent on gravity forces acting on the inflow control elements. The valve may for example be oriented by using an orientation means disclosed in Norwegian Patent application NO 20161700.

The valve is suitable for use in a horizontal well, i.e. a well having an angle of at least eighty degrees to a vertical wellbore. However, tests have surprisingly shown that the valve is suitable also for a deviated well having an angle of at least forty-five degrees to a vertical wellbore. The tests show that the valve will function satisfactorily as long there is a well-defined stratified flow of fluids immediately upstream of the flow barrier of the valve.

BRIEF DESCRIPTION OF THE DRAWINGS

In the following is described examples of preferred embodiments illustrated in the accompanying drawings, wherein.

DETAILED DESCRIPTION OF THE DRAWINGS

Figure 1:
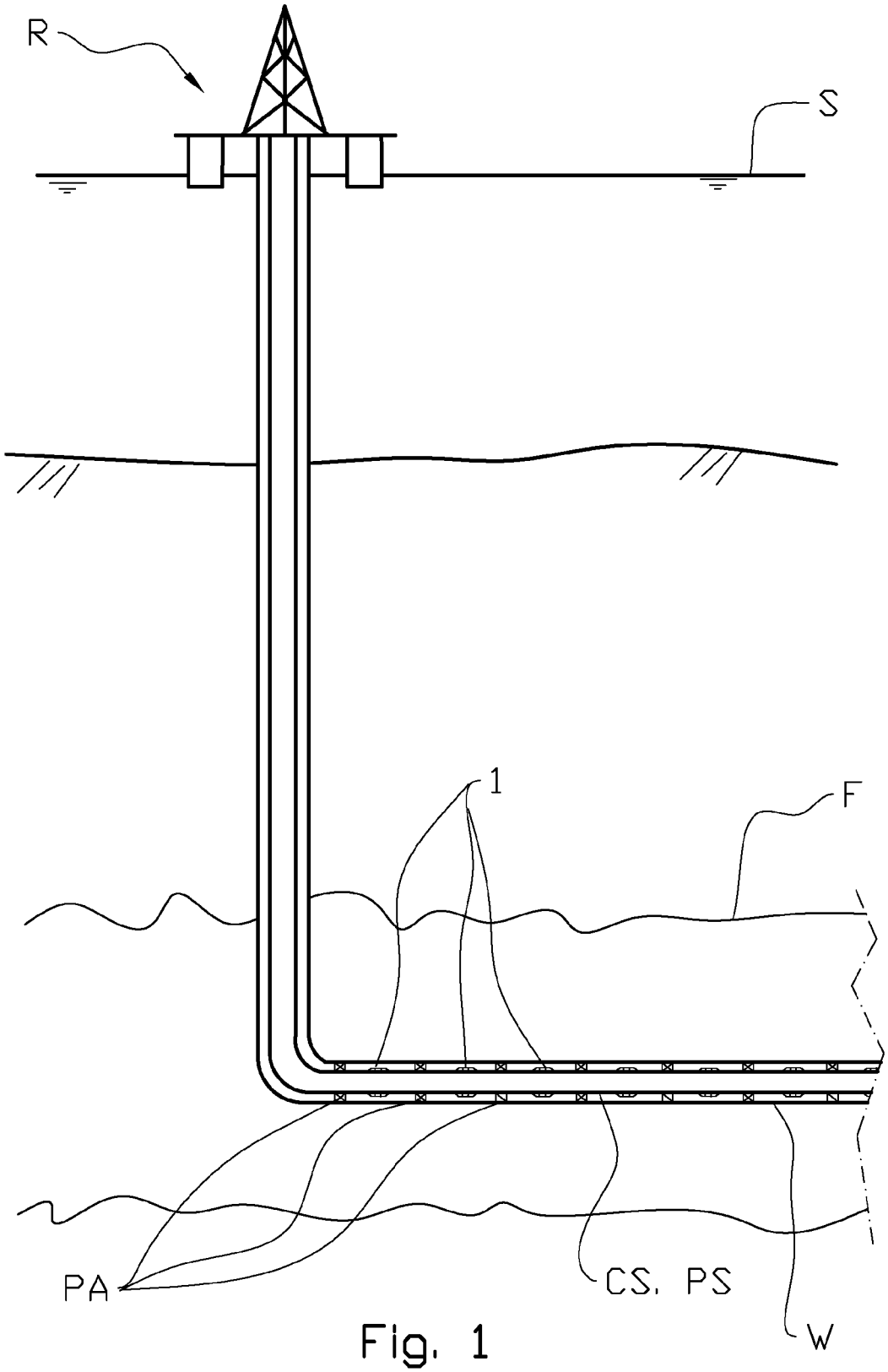
FIG. 1 shows a principle sketch of a typical subsea well having a plurality of valves according to the present invention distributed along a horizontal section of the well.

Positional indications such as for example "above", "below", "upper", "lower", "left", and "right", refer to the position shown in the figures.

In the figures, same or corresponding elements are indicated by same reference numerals. For clarity reasons some elements may in some of the figures be without reference numerals.

A person skilled in the art will understand that the figures are just principle drawings. The relative proportions of individual elements may also be strongly distorted.

In the figures, the reference numeral 1 denotes a valve according to the present invention.

FIG. 1 shows a typical use of the valve 1 in a well completion string CS arranged in a substantially horizontal wellbore or well W penetrating a reservoir F. The well W is in fluid communication with a rig R floating in a surface of a sea S. The well W comprises a plurality of zones separated by packers PA, for example so-called swell packers, as will be appreciated by a person skilled in the art. A person skilled in the art will understand that the well W may alternatively be an onshore well.

In FIG. 1, one valve 1 is shown between each pair of packers PA. However, it should be clear that two or more valves 1 will typically be arranged between each pair of packers PA.

Figure 2:
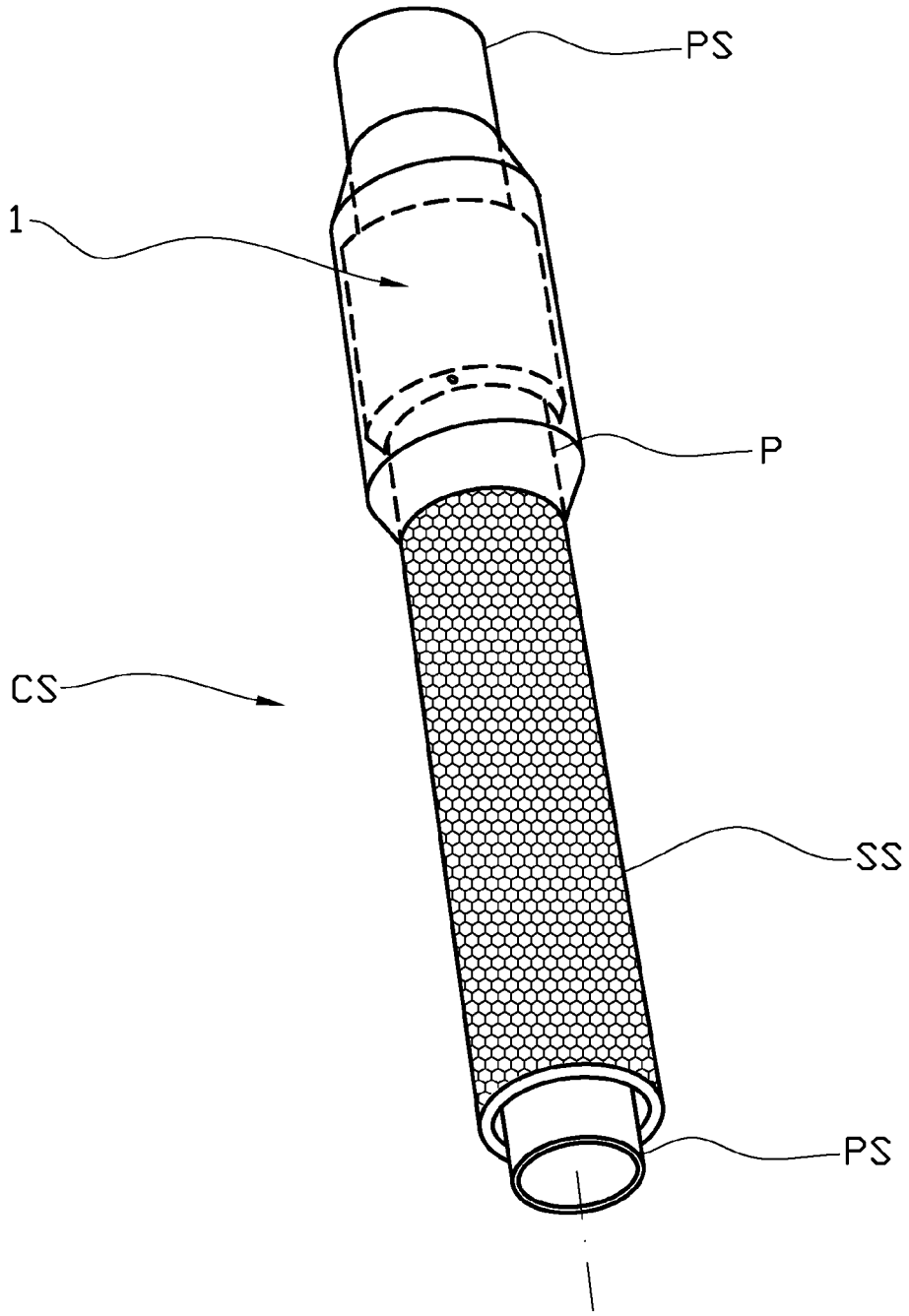
FIG. 2 shows in larger scale a perspective view of a pipe stand comprising a base pipe and a screen, and an apparatus according to the present invention.

FIG. 2 shows a typical arrangement of the valve 1 in a portion of a well completion string CS. The valve 1 is positioned between a basepipe P and a sandscreen SS. In FIG. 2, the valve 1 according to the invention is indicated with broken lines.

The valve 1 may form part of a so-called pipe stand that may have a typical length of approximately 12 meters. However, the valve 1 may also be arranged in a separate pipe unit having for example a length of only 40-50 centimeters. Such a unit may be configured to be inserted between two subsequent pipe stands.

The valve 1 according to the invention is orientation dependent. In the figures, this is indicated by a g-vector.

In order to explain a basic principle of the valve 1 according to the invention, reference is first made to FIGS. 3*a*-3*h*. It should be emphasized that the primary purpose of FIGS. 3*a*-3*h* is to explain how a position of an axially movable piston arrangement is activated when an undesired fluid, here in the form of water or gas, exceeds a predetermined level. For explanatory reasons, each of the FIGS. 3*a*-3*h* comprises multiple cross-sections of the valve 1.

To the left of each of the FIGS. 3*a*-3*h* is shown an explanatory FIG. 9*a*-9*h*, respectively, showing a vertical cross-section taken at the right portion of two inflow control elements, here shown as balls 30, 30', and seen in an inclined angle as indicated by the dotted arrow S. The purpose of the FIGS. 9*a*-9*h* is to help understanding the principle drawings 3*a*-3*h*.

Figure 4A:
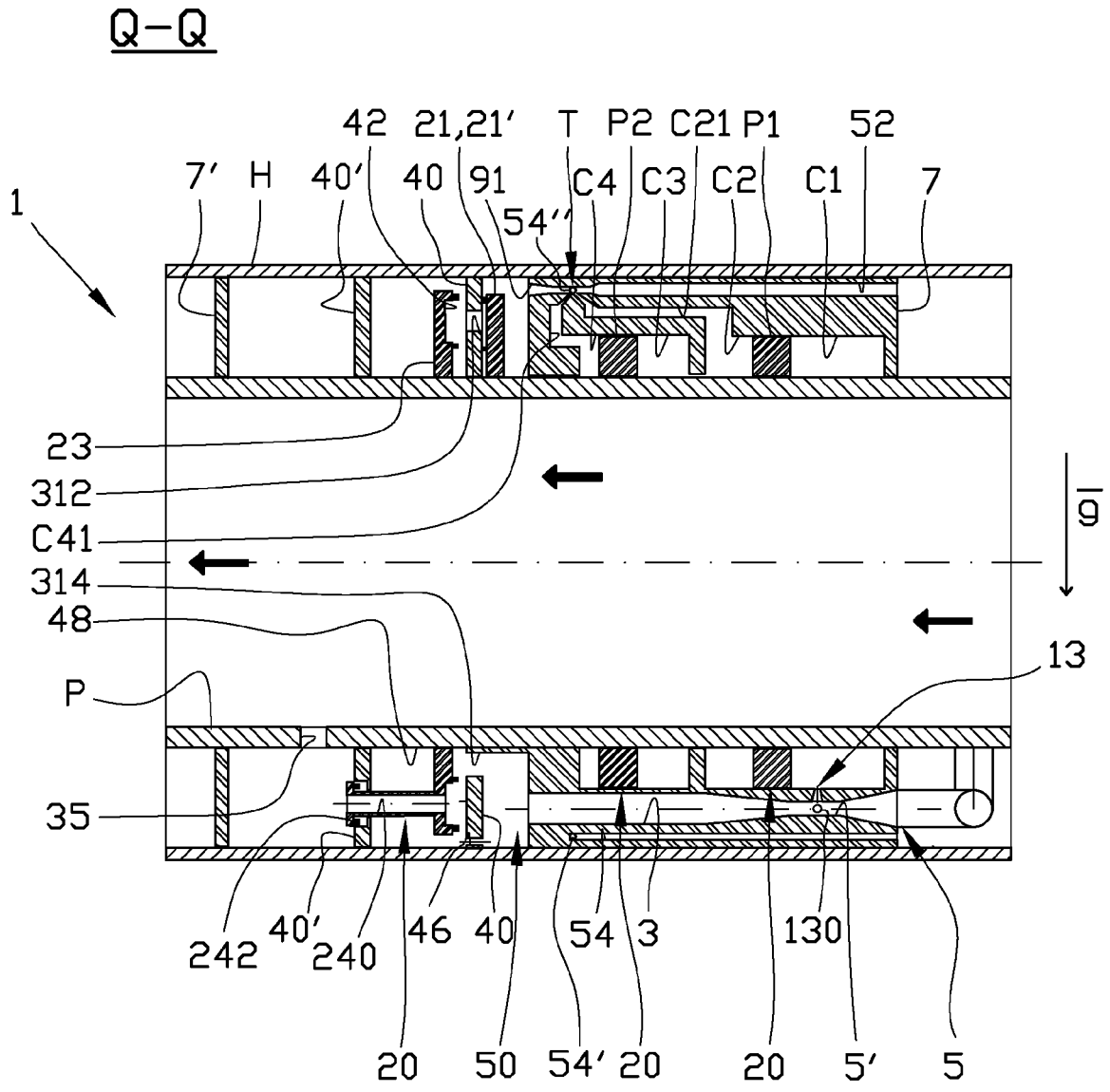
FIG. 4*a* shows an axial cross-section through the valve in an open position, the valve being configured for blocking inflow of water and gas exceeding a predetermined level.

A more detailed description of embodiments of the valve 1 are disclosed in FIG. 4*a* et seq.

In FIGS. 3*a*-3*h*, the valve 1 comprises a primary flow channel 3 having a primary inlet 5 through a flow barrier 7 and a primary outlet 50. The primary flow channel 3 is configured for influencing a pressure of the fluid through the channel 3. In the embodiment shown, the primary flow channel comprises a venturi with a vena contracta portion 5' for providing a low pressure portion. Fluid flow through the valve 1 for each flow regime is indicated by multiple arrows from the upstream portion of the valve 1 and through the valve 1.

The valve 1 further comprises a secondary flow channel having two separate flow paths, wherein a first flow path has a first inlet 11 and a second flow path has a second inlet 110 through the flow barrier 7, and a secondary flow channel outlet, here in the form of a pilot hole 13 being in fluid communication with a vena contracta portion 5', i.e. a low pressure portion of the primary flow channel 3. As will be discussed below and shown for example in FIG. 4*f*, it is preferred that the two paths of the secondary flow channel communicate with the primary flow channel via separate outlets 13, 130 from the flow paths.

The secondary flow channel first inlet 11 and the secondary flow channel second inlet 110 are arranged in two different guiding means or paths 32' and 32, respectively. for the balls 30', 30.

The valve 1 further comprises a bypass flow channel having a first bypass flow channel inlet 31 and a second bypass flow channel inlet 310. The bypass flow channel is in fluid communication with a bypass channel outlet 312. In what follows, the term "flow channel" will also be denoted "channel".

The first bypass channel inlet 31 is arranged in the same path 32 as the secondary flow channel second inlet 110, and the second bypass channel inlet 310 is arranged in the same path 32' as the secondary flow channel first inlet 11.

The valve 1 is provided with a piston arrangement 20 that comprises a first piston P1 for defining a first piston chamber C1 and a second piston chamber C2 within a piston housing PH, and a second piston P2 for defining a third piston chamber C3 and a fourth piston chamber C4 within the piston housing PH. The first and second pistons P1, P2 are interconnected by a connection means here in the form of rods R (shown in FIGS. 3*a*-3*h*). The rods R also connect the pistons with other parts of the piston arrangement 20, as shown by two rods extending downstream of the second piston P2.

The secondary flow channel first inlet 11 is in fluid communication with the first piston chamber C1, thereby forming part of one of the two flow paths of the secondary flow channel, and the secondary flow channel second inlet 110 is in fluid communication with the third piston chamber C3 by means of a third piston chamber channel C110, thereby forming part of the other one of the two flow paths of the secondary flow channel. The first piston chamber C1 and the third piston chamber C3 are in fluid communication with the primary flow channel 3 at the outlet or pilot hole 13, and preferably outlet 130 (see FIG. 4*f*) of the vena contracta portion 5', respectively.

The bypass channel first inlet 31 and a bypass channel second inlet 310 are in fluid communication with the second piston chamber C2 and the fourth piston chamber C4 by means of a second piston chamber channel C31 and a fourth piston chamber channel C310, respectively.

The second piston chamber C2 and the fourth piston chamber C4 are in fluid communication with the bypass channel outlet 91 via channels C21 and C41, respectively.

In the embodiment shown, the valve 1 further comprises a first leakage channel 52 and a second leakage channel 54. The first leakage channel 52 is provided with a vena contracta for providing an underpressure therein.

The second leakage channel 54, the channel C21 and the channel C41 merge with the first leakage channel 52 at the vena contracta of the first leakage channel 52. This merging point will hereinafter be denoted tee T.

Although not specifically shown in FIGS. 3*a*-3*g*, it should be clear that a hydraulic resistance of the secondary outlet 13, or the pilot hole, is larger than the hydraulic resistance of the secondary flow channel first and second inlets 11, 110. Similarly, it should be clear that a hydraulic resistance of the channels entering tee T is larger than the hydraulic resistance of the bypass channel first and second inlets 31, 310, respectively, and the inlets of the leakage channels 52, 54.

The bypass channel outlet 312 is closable by a bypass channel closing element 21 forming part of the piston arrangement 20. The bypass channel outlet 312 is closed when the primary flow channel 3 is open, i.e. when the piston arrangement 20 is in its inactive position.

The piston arrangement 20 is further provided with a primary channel closing element 23 for closing the outlet of the primary flow channel 3 when the piston arrangement 20 is in its active position. The primary channel closing element 23 is further configured to enclose a periphery of the bypass channel outlet 312 when the piston arrangement 20 is in its active position. The primary channel closing element 23 is provided with an annular cavity 42 forming a conduit (indicated in principle by dotted line 44) for allowing a fluid communication from the bypass channel outlet 312 to a closing element outlet 23' when the piston arrangement 20 is in its active or closed position.

In what follows, a working principle of the valve 1 will be explained for various fluid situations that are likely to occur in an oil producing well. In the various fluid situations, it is assumed that the valve 1 will be subjected to either a single phase of fluid, i.e. oil, water or gas, or two phases simultaneously, i.e. oil and water, or oil and gas. Further, the fluid will not "switch" directly from water to gas or from gas to water. Oil is always one of the two fluids involved. Those assumptions will be appreciated by a person skilled in the art.

The inflow control elements 30, 30' are shown as balls. The first inflow control element 30 of the two inflow control elements 30, 30' has a density between that of oil and gas. For simplicity, the first inflow control element will hereinafter also be denoted "the light ball 30". The second inflow control element 30' has a density between that of oil and water and will hereinafter also be denoted "the heavy ball 30".

Figure 3A:
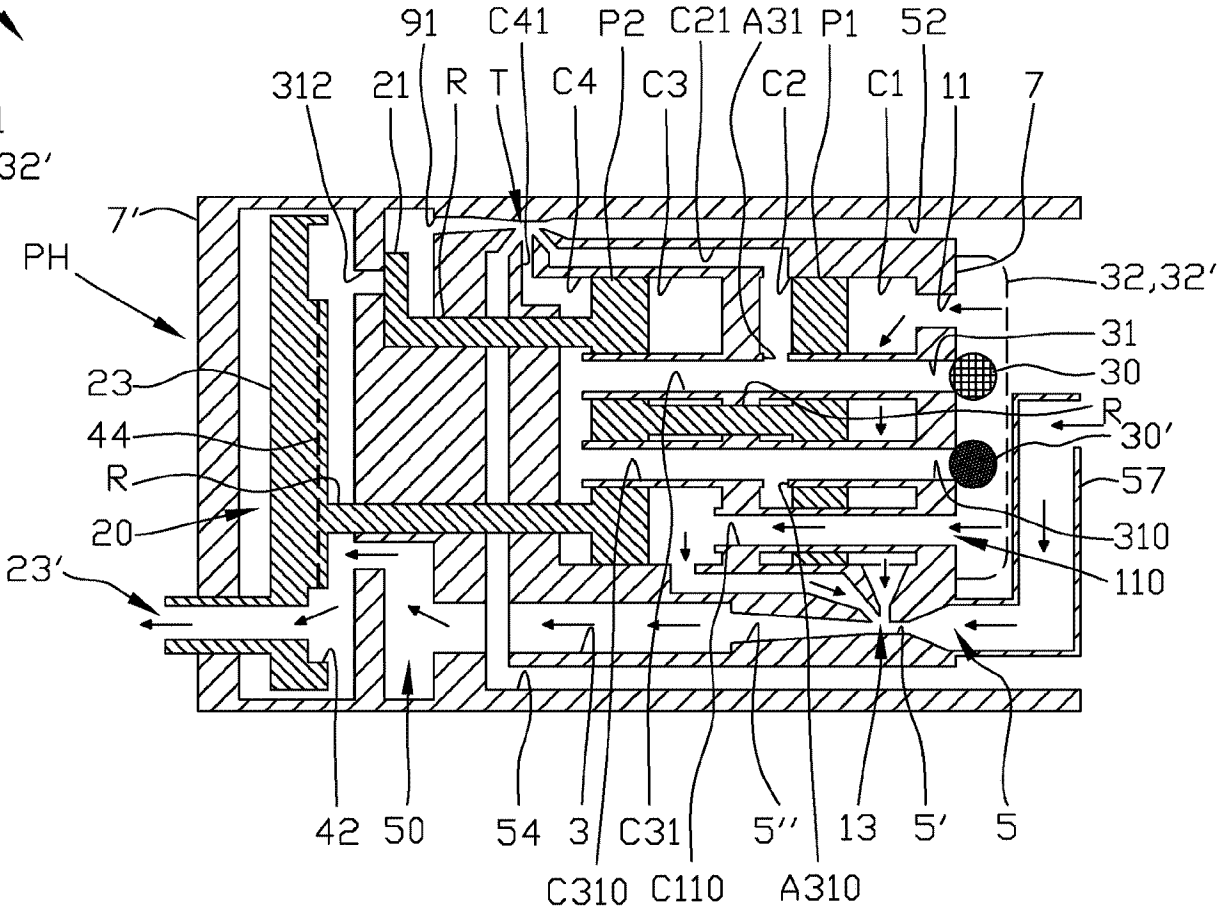
FIG. 3*a*-3*h* illustrate an important operation principle of the valve according the invention.
Figure 9A:
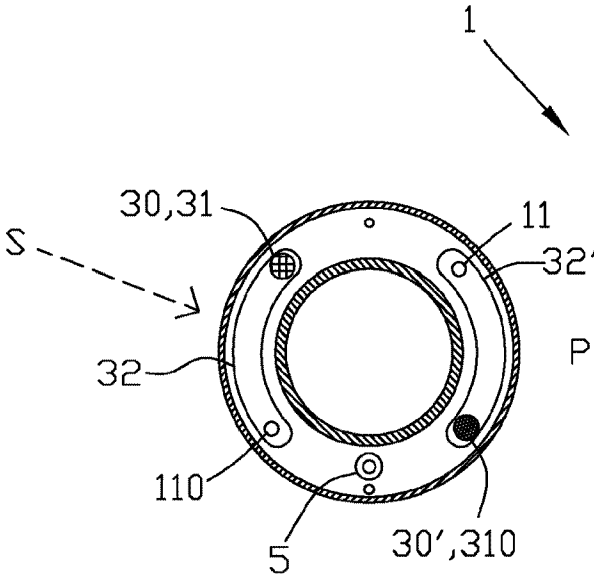
FIGS. 9*a*-9*h* shown to the left of each of the FIGS. 3*a*-3*h*, respectively, is a vertical cross-section taken at the right portion of two inflow control elements.

Turning now to FIG. 3*a*, the fluid flowing through the valve is a single-phase oil drained from for example the reservoir F as shown in FIG. 1. In this situation, the piston arrangement 20 is in the inactive or open position, i.e. to the leftmost position. The light ball 30 is in the upper position in the first path 32 blocking bypass flow channel first inlet 31. The heavy ball 30' is in the lower position in the second path 32' blocking the secondary flow channel second inlet 310.

The oil flows through the valve 1 via the primary flow channel 3 comprising the vena contracta 5' and an expansion portion 5" downstream of the vena contracta 5'. Oil also flows from the secondary flow channel first inlet 11 and second inlet 110 via chamber C1 and C3, respectively, and via the secondary flow channel pilot hole 13 into the primary flow channel 3. As will be explained in more detail below, it is preferred that the fluid flows from chamber C3 into the primary flow channel 3 via a separate inlet 130 as shown for example in FIGS. 4*a*-4*c* and FIG. 4*f*.

There is no flow out of the bypass channel outlet 312, and consequently there is no flow in the second piston chamber C2 and fourth piston chamber C4.

Due to the restriction at the secondary flow channel outlet or pilot hole 13, there is high pressure in chambers C1 and C3. There is also high pressure in chambers C2 and C4 because the pressure immediately upstream of the barrier 7 propagates through the tee T into chambers C2 and C4. By high pressure is meant a pressure substantially corresponding to the pressure immediately upstream of the barrier 7. Consequently, with high pressure in all four chambers C1, C2, C3 and C4, fluid pressure is equalized across the balls 30, 30'.

Upstream of the barrier 7 there is a fluid having a high pressure. In the vena contracta portion 5' of the primary flow channel 3, there will be a low pressure. In a producing well that is in fluid communication with a downstream portion of the primary flow channel 3, a partial pressure recovery will exist downstream of the venturi that comprises the vena contracta portion 5'. The partial pressure recovery will result in a medium fluid pressure downstream of the venturi. Due to the hydraulic resistance of the pilot hole 13 being larger than the hydraulic resistance of the secondary flow channels inlets 11, 110, a high pressure will exist also in the chambers C1 and C3 forming part of the secondary flow channel 9. Thus, there will be a pressure difference across the valve 1 which urges the piston arrangement 20 to the left. In this position, the piston arrangement 20 does not close the primary flow channel 3 as will be explained in more details from FIG. 4*a* et seq.

The terms high pressure, medium pressure and low pressure denote mutual relative fluid pressures upstream of and within the valve 1.

Thus, due to the vena contract 5' of the primary flow channel 3 providing a pressure difference across the valve 1, a small net force will keep the piston arrangement 20 in its inactive open position as shown.

Figure 3B:
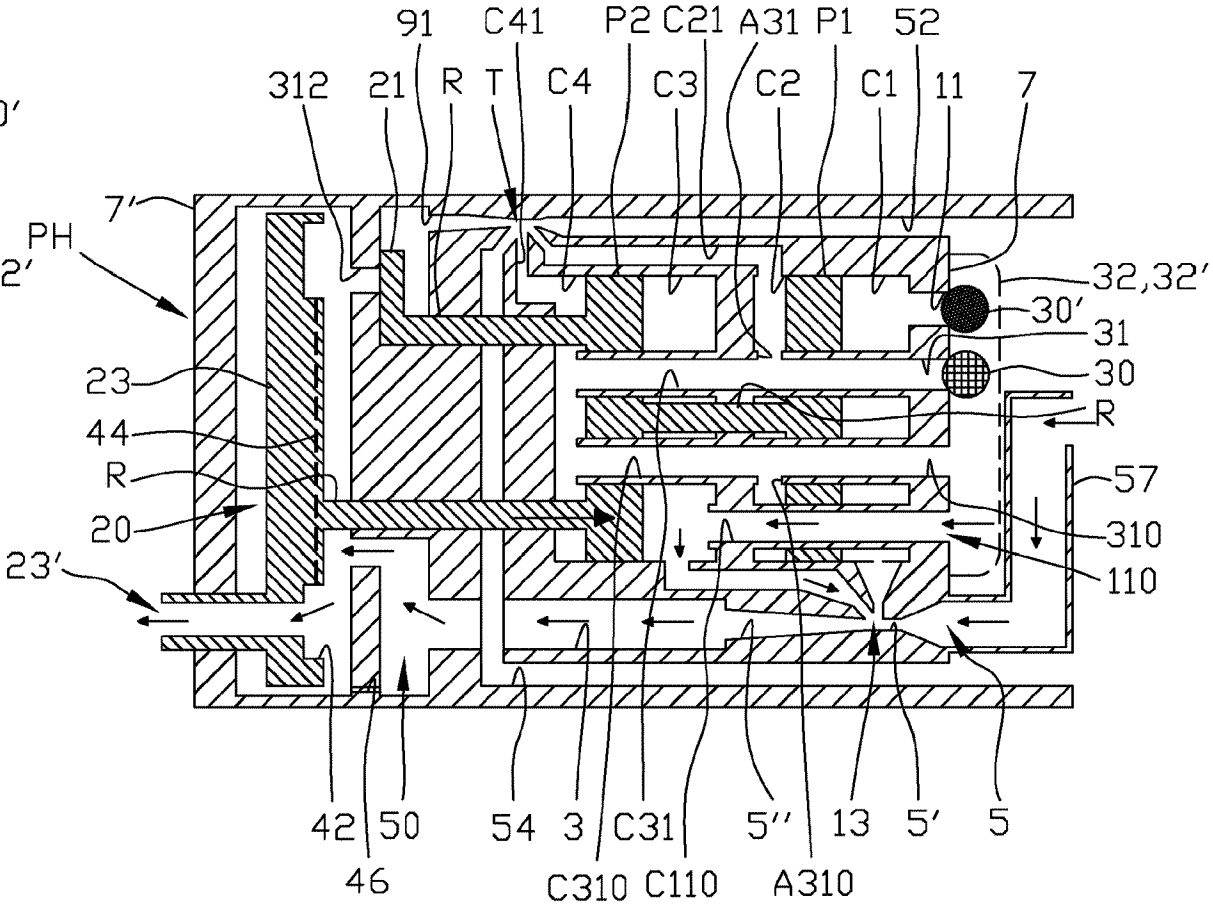
Figure 9B:
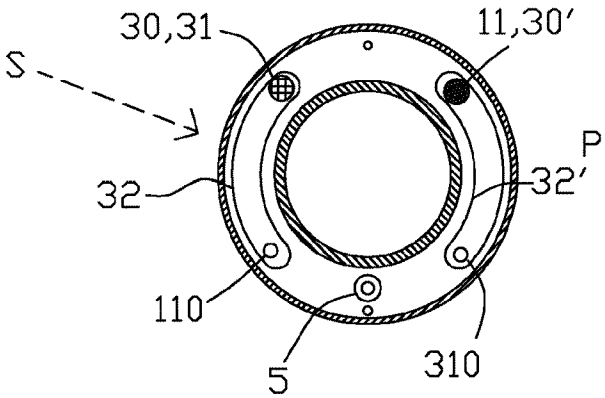

FIG. 3*b* shows a situation wherein water has started to flow through the valve 1, but before the valve 1 is closed.

The limiting water fraction above which the valve 1 closes, depends on the diameter ratio of the secondary outlet or pilot hole 13 and vena contracta 5'. If it is preferred that the valve 1 closes at a high water cut, for example above 80%, the secondary flow channel outlet 13 should have a small diameter, such as for example 1 mm. If a small diameter represents an unacceptable risk of particle blockage, the secondary outlet 13 can alternatively be replaced by a long circular tube with the smallest acceptable diameter. By making the tube sufficiently long, for example by winding it helically around the barrel P, the limiting water fraction can become very close to 100%.

For low water fractions, for example 10%, all the water will flow through the secondary flow channel second inlet 310.

As the water fraction increases, the water level upstream of the barrier 7 and heavy ball 30' will ascend to the inlet level of the inlet tube 57. For even higher water fractions, for example above 90%, the water level and heavy ball 30' will ascend further until it blocks the secondary flow channel first inlet 11 as shown in FIG. 3*b*.

As the secondary flow channel first inlet 11 has now been blocked by the heavy ball 30', the low pressure in vena contracta 5' will immediately propagate into chamber C1, but the pressure in the other three piston chambers C2, C3 and C4 is still high. A net pressure force will therefore urge the piston arrangement to the right as indicated by the arrow shown on the piston arrangement and bring the piston arrangement 20 to its active position, as shown in FIG. 3*c*.

Figure 3C:
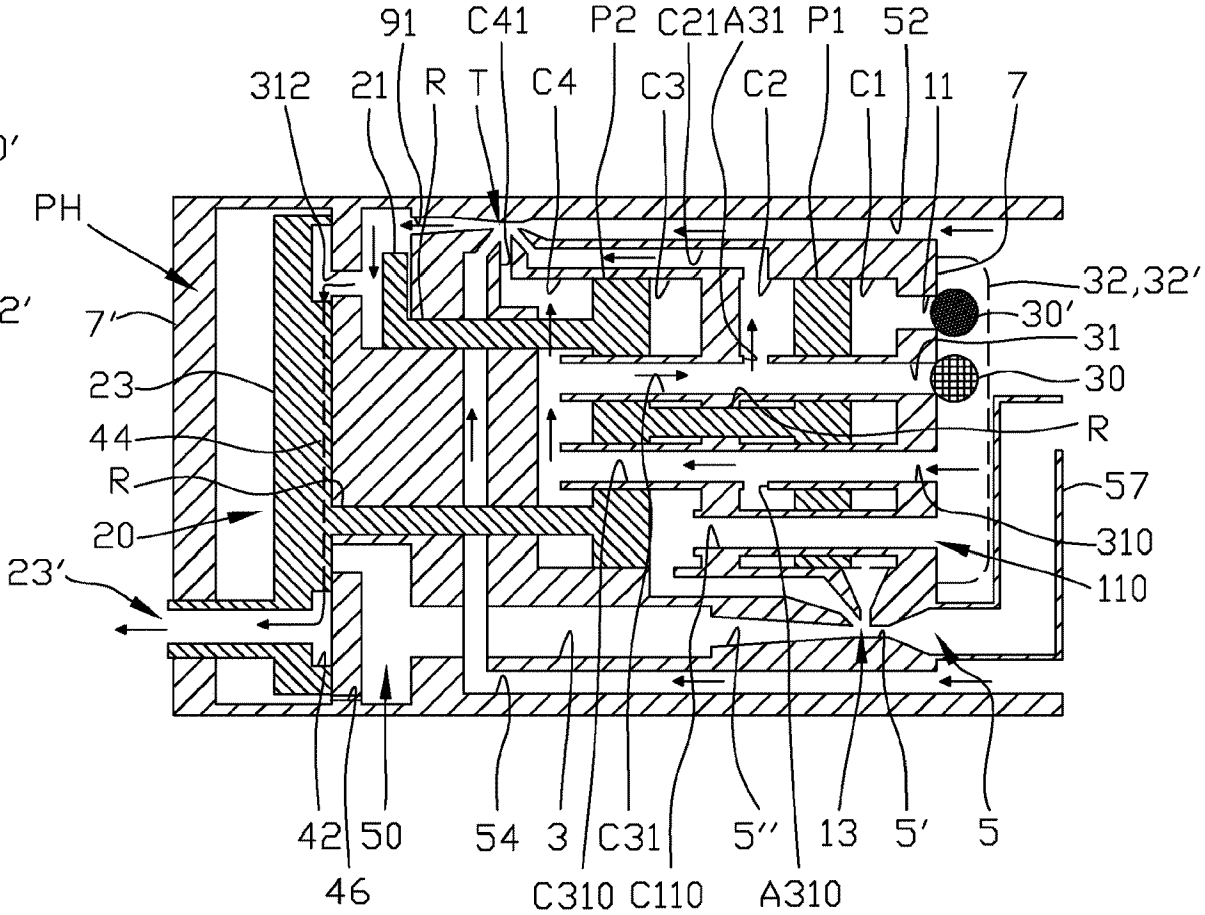
Figure 9C:
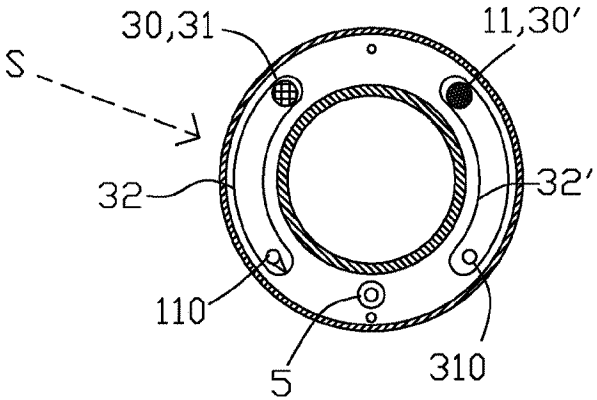

In FIG. 3*c*, the water flows through the tee T, entering from the first leakage channel 52, the second leakage channel 54, channel C21 from the second piston chamber C2 and channel C41 from the fourth piston chamber C4. There is no flow through the secondary flow channel pilot hole 13 because the primary outlet 50 of the primary flow channel 3 is closed by the closing element 23.

Thus, in the single-phase water situation shown in FIG. 3*c*, there is high pressure in all four chambers C1, C2, C3 and C4. A small net force will keep the piston arrangement 20 in its closed position due to a pressure communication channel 46 and an annular cavity 42. This is explained below when discussing for example FIG. 4*c*.

In the situation shown in FIG. 3*c*, the pressure across the heavy ball 30' is equalized, while the pressure across the light ball 30 is substantially equalized.

Figure 3D:
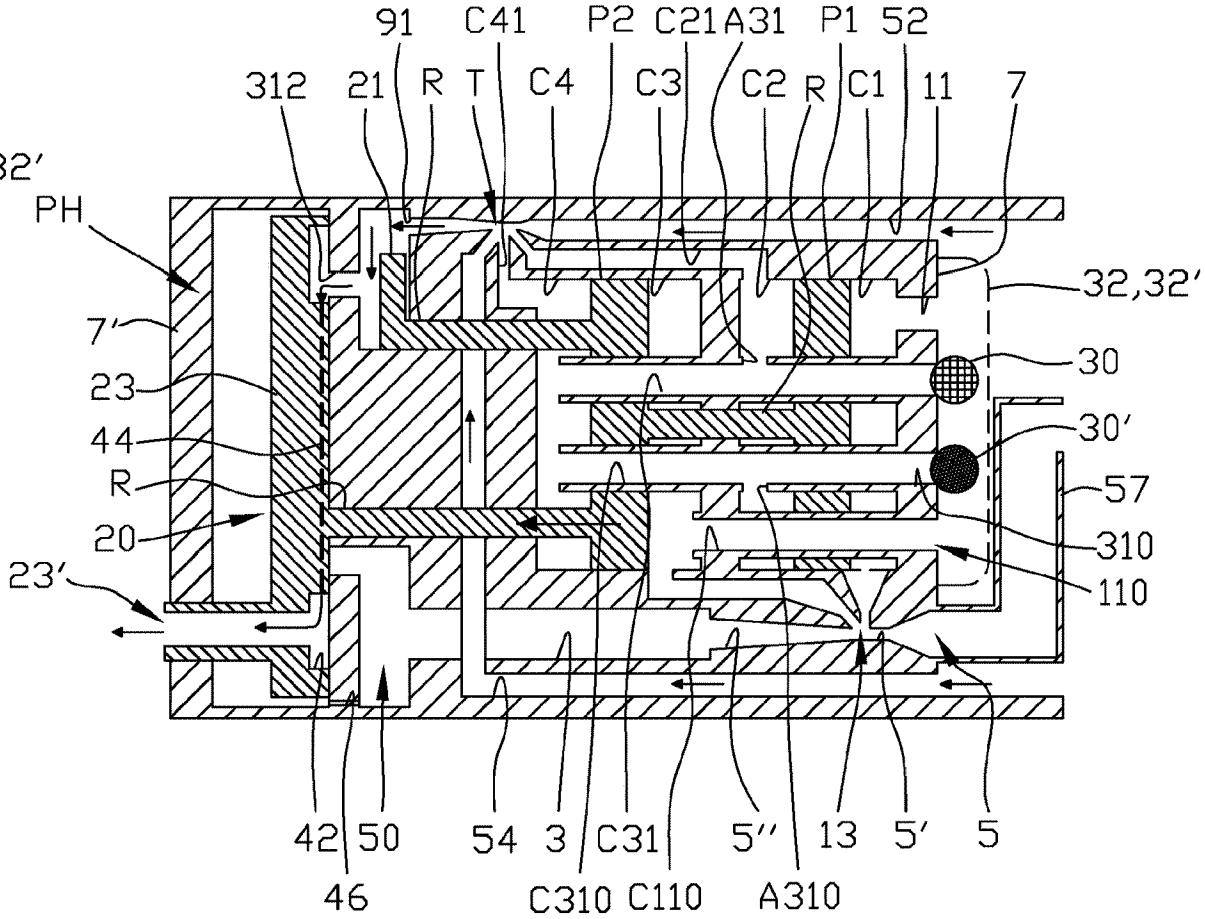
Figure 9D:
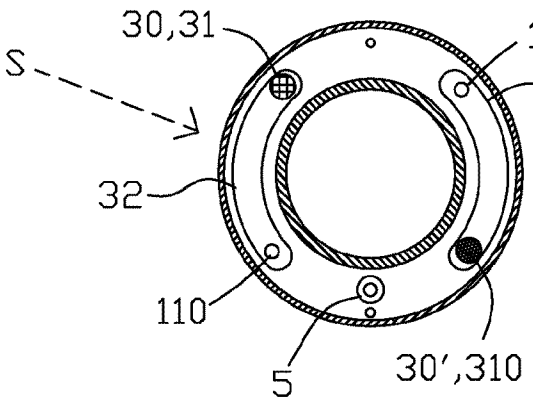
Figure 3E:
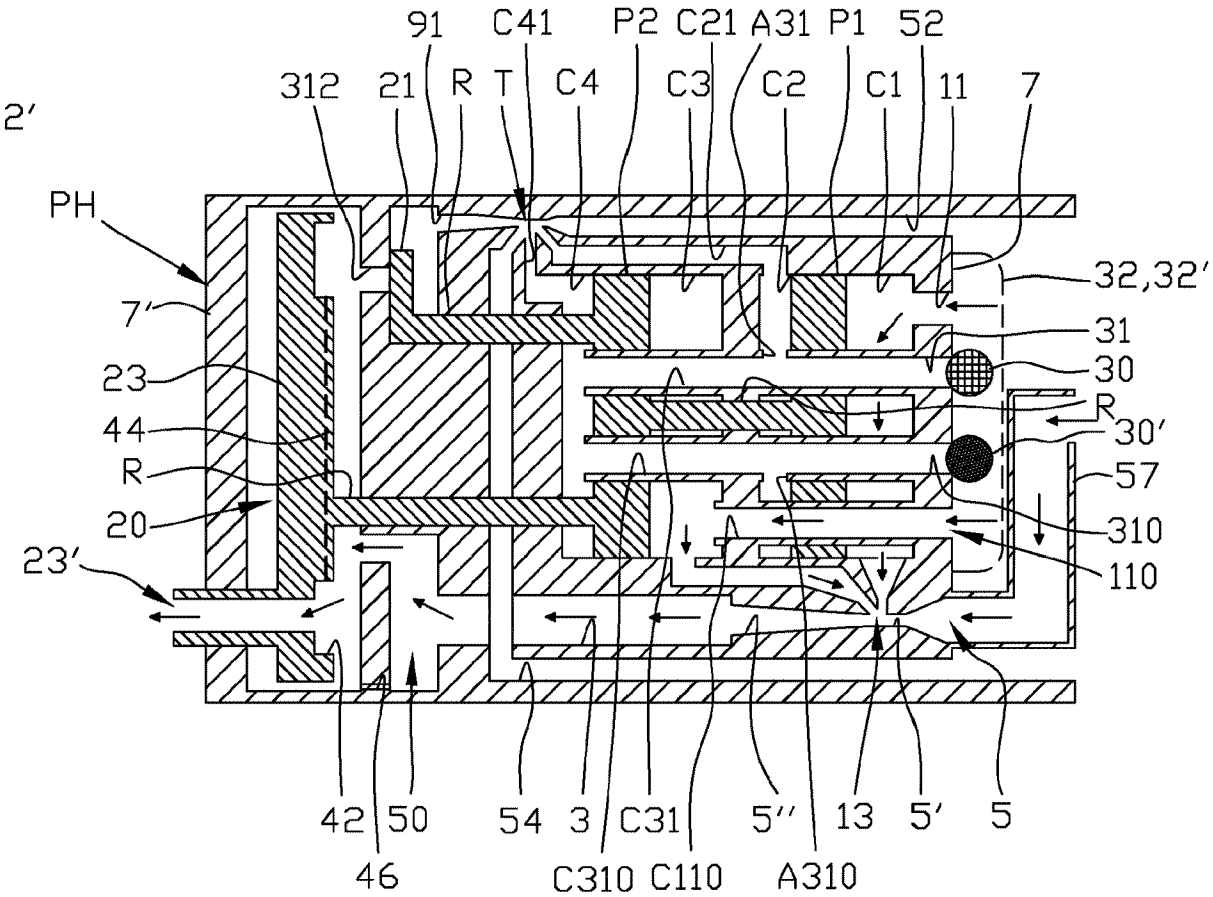
Figure 9E:
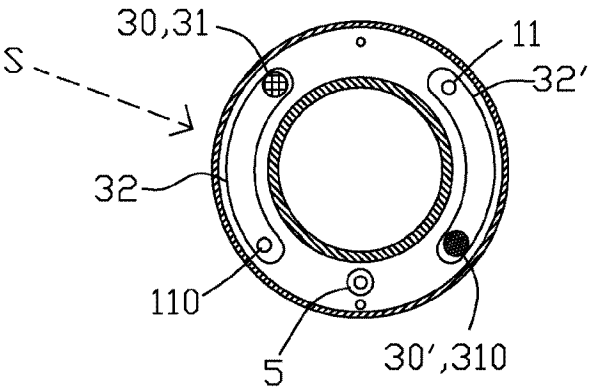

FIG. 3*d* illustrates a situation where oil starts coming back, but before the valve 1 reopens. For low oil fractions, for example less than 10%, all oil will flow through the inlet of first leakage channel 52 at the top portion of the restriction 7. As the oil fraction increases, for example to 40%, the water level and the heavy ball 30' will descend to bypass channel second inlet 310. The second piston chamber C2 and the fourth piston chamber C4 will then be subjected to a low pressure propagating from the tee T, while the first piston chamber C1 and the third piston chamber C3 will be subjected to a high pressure. Thus, a net pressure force will start urging the piston arrangement from the right, i.e. active position, to the left, i.e. inactive position as indicated by the arrow shown on the second piston, until the primary flow channel 3 is open as shown in FIG. 3*e* (and also in the identical FIG. 3*a*).

When the valve 1 has been closed due to water or gas, as shown in FIG. 3*c* and FIG. 3*d*, respectively, the pressure regime within the valve 1 will be equalized with the pressure upstream of the valve 1, including the pressure across the inflow control elements 30, 30', i.e. the light ball 30 and heavy ball 30'. The only exception is the annular cavity 42, which is in pressure communication with the outlet 23' and therefore contributes to keeping the valve closed.

Figure 3F:
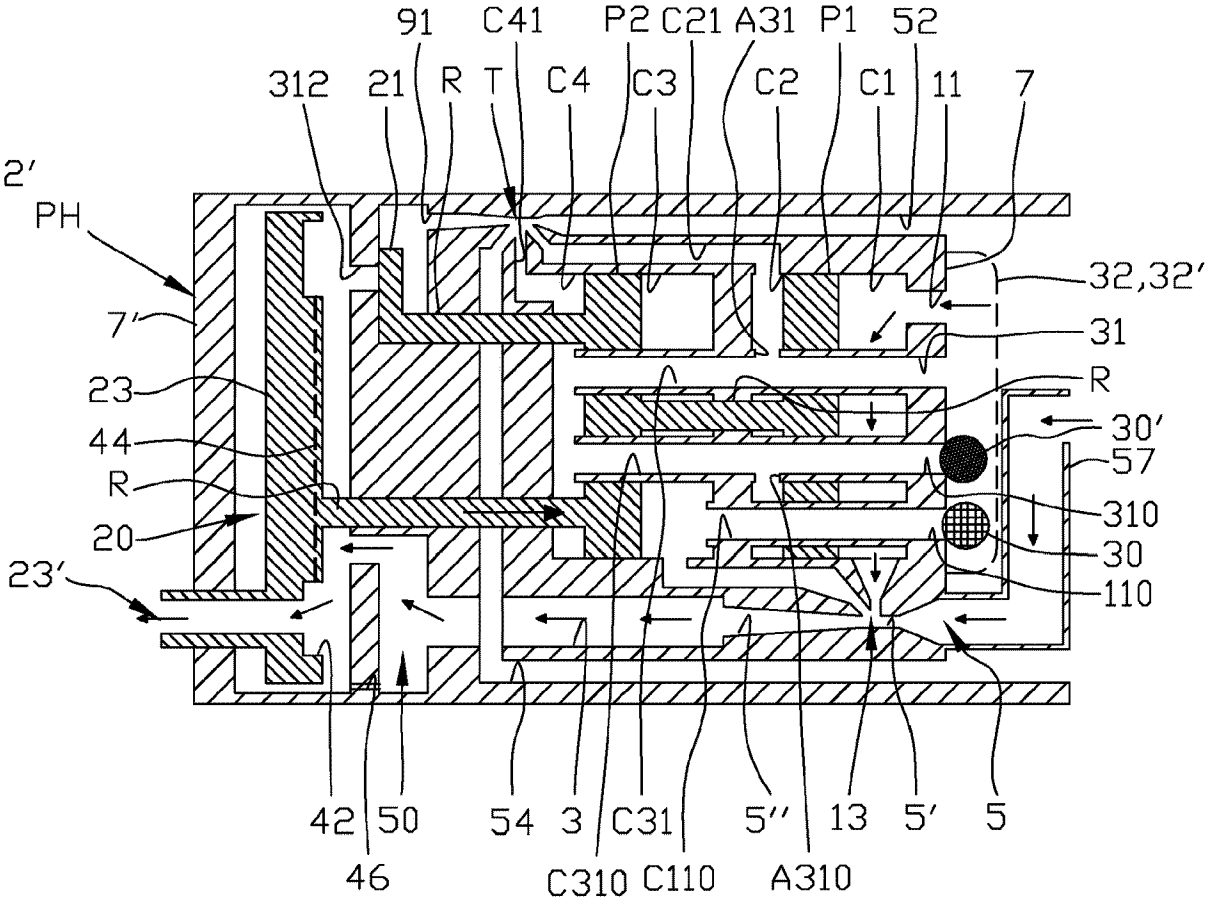
Figure 9F:
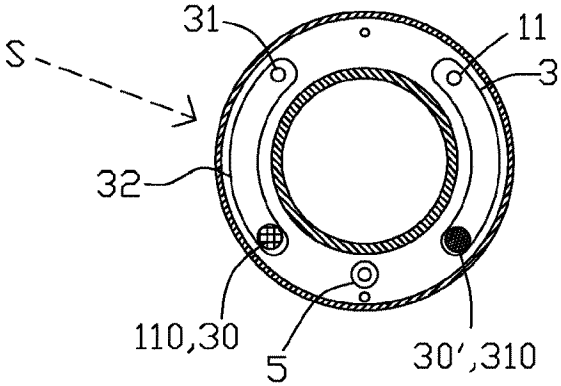

FIG. 3*f* shows a situation wherein gas, in addition to oil, starts flowing through the valve 1. For low gas fractions, for example less than 10% gas, all the gas will flow through the secondary flow channel first inlet 11. As the gas fraction increases, the oil level and the light ball 30 will descend to the inlet level of the inlet tube 57. As the gas fraction increases further, for example above 75% the oil level and the light ball 30 will descend further until the light ball 30 blocks the secondary flow channel second inlet 110, as shown in FIG. 3*f*. When the secondary flow channel second inlet 110 is blocked by the light ball 30 while at the same time the heavy ball 30' blocks the bypass channel second inlet 310, there will be a low pressure in the third piston chamber C3 and high pressure in the other three chambers C1, C2 and C4. A net pressure force will therefore urge the piston arrangement towards right as indicated by the arrow near the second piston P2, until the piston arrangement 20 is in its active or closed position as shown in FIG. 3*g*.

Figure 3G:
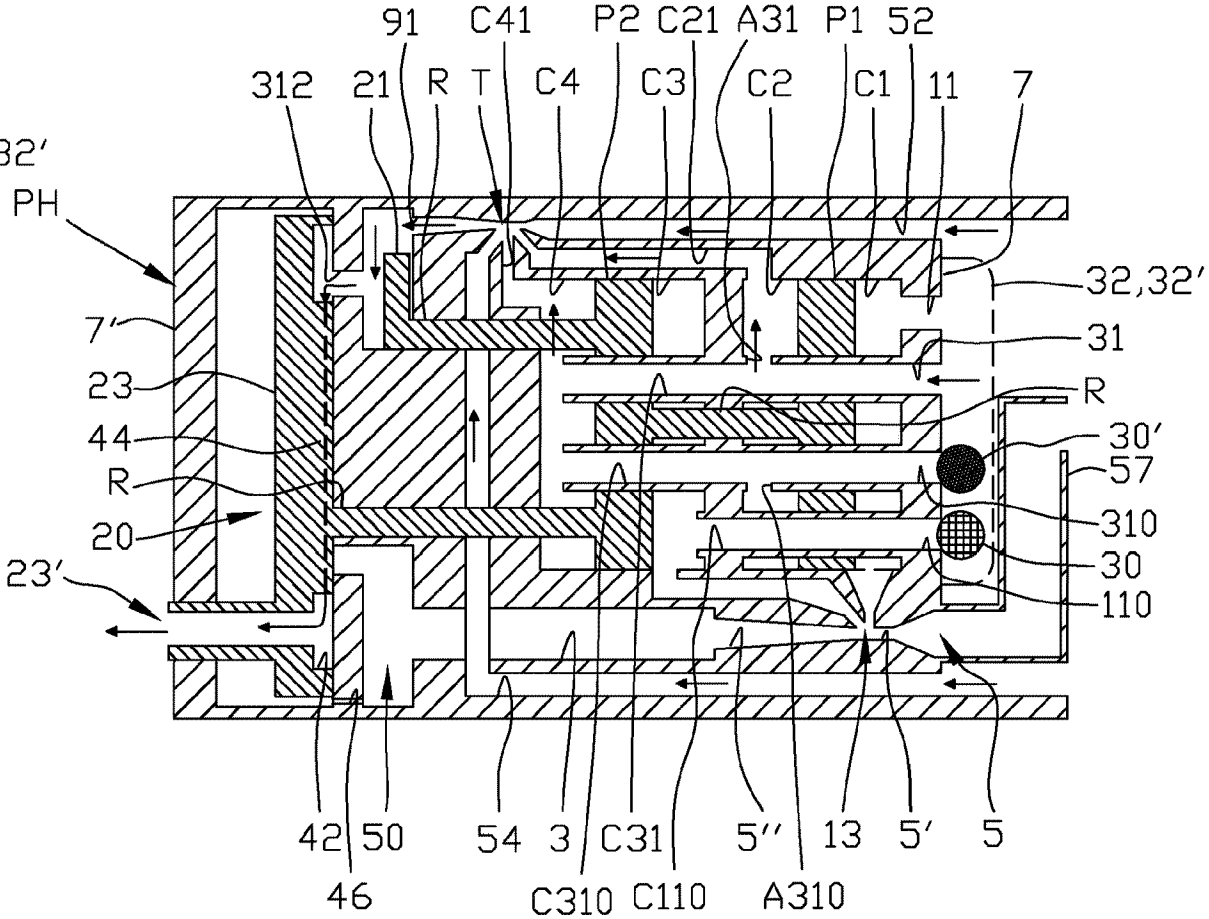
Figure 9G:
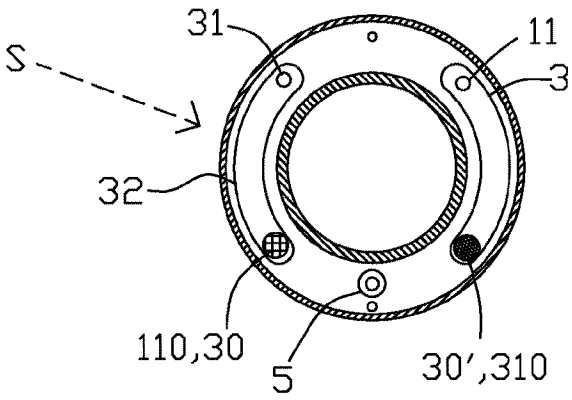
Figure 3H:
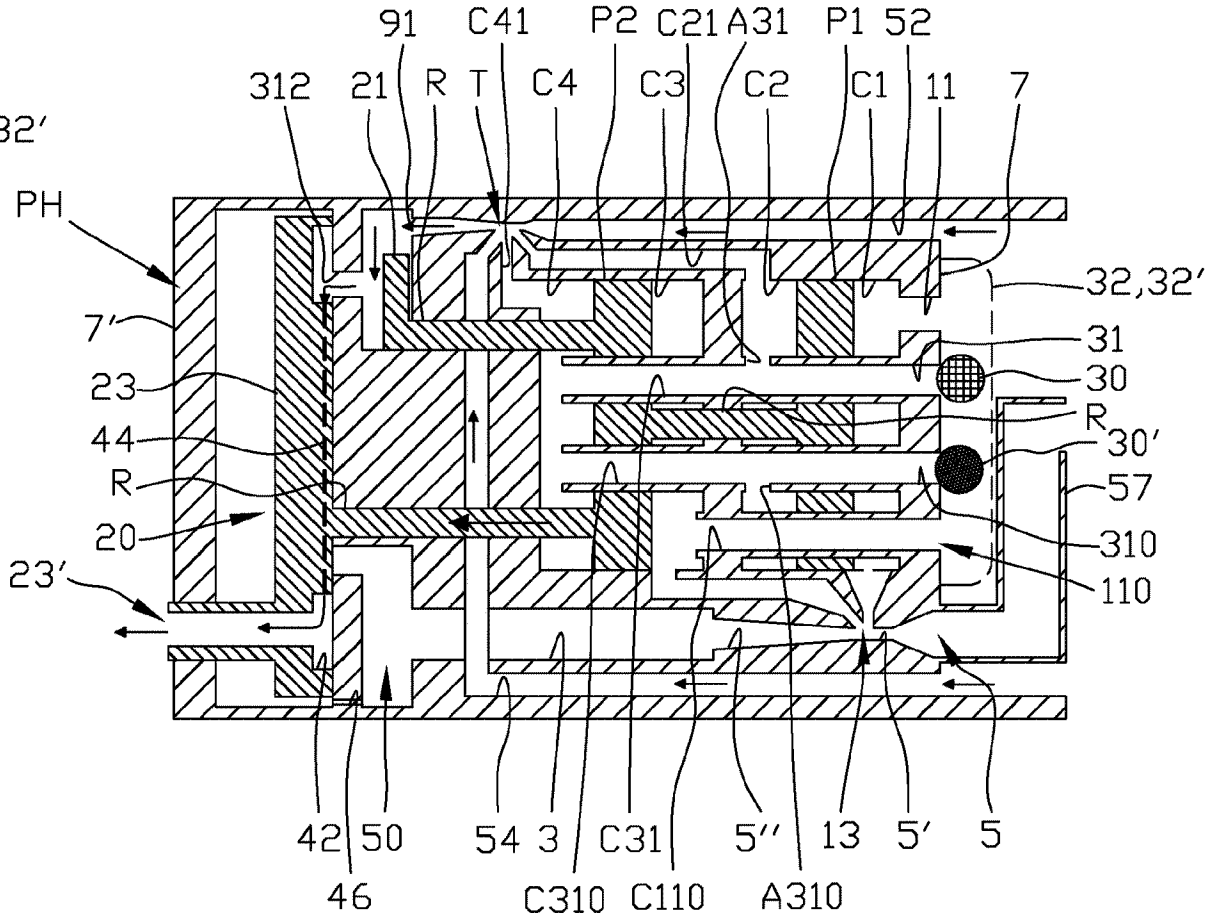
Figure 9H:
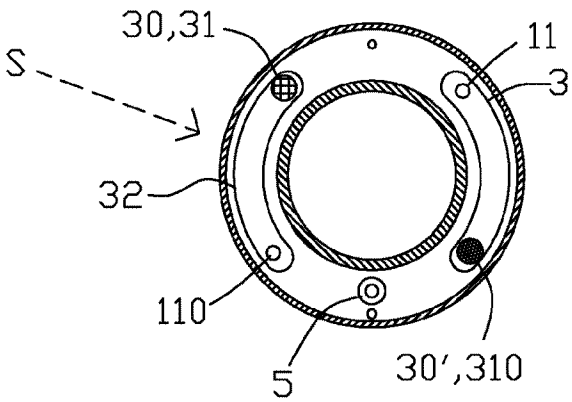

In FIG. 3*g* the light ball 30 and the heavy ball 30' will be in a lowermost position within their respective paths 32, 32', blocking secondary flow channel inlet 110 and bypass flow channel second inlet 310, respectively. Gas leaks through the tee T, entering from the first leakage channel 52, the second leakage channel 54, channel C21 from the second piston chamber C2 and channel C41 from the fourth piston chamber C4. There is no flow through the secondary flow channel pilot hole 13 because the primary outlet 50 of the primary flow channel 3 is closed by the closing element 23. The leakage of gas through the tee T is due to the annular cavity 42 forming the conduit (indicated by dotted lines) 44 in the primary channel closing element 23 wherein the conduit 44 provides fluid communication between the bypass channel outlet 312 and the closing element outlet 23'. Due to this leaking of gas, the valve 1 is capable of reopening if/when oil starts coming back, as shown in FIG. 3*h*.

For low oil fractions, for example less than 20%, the oil will flow through the second leakage channel 54 arranged at a lower portion of the restriction 7. As the oil fraction increases, for example to 50%, the oil level and the light ball 30 will start to ascend until it blocks the bypass flow channel first inlet 31, as shown in FIG. 3*h*. Then, there will be a low pressure in the second piston chamber C2 and in the fourth piston chamber C4, and a high pressure in the first piston chamber C1 and the third piston chamber C3. A net pressure force will therefore urge the piston arrangement 20 towards left until the piston arrangement is in its inactive or open position as shown in FIGS. 3*a* and 3*e*. In this situation, the pressure across the light ball 30 and heavy ball 30' is equalized.

Both in their first position and the second position the inflow control elements 30, 30', i.e. the light ball 30 and heavy ball 30', are located at a distance from the inlet level of the inlet tube 57 which is connected to primary inlet 5 of the primary flow channel 3. Thus, the inflow control elements 30, 30' will not be subject to a stratified flow that may occur at the inlet tube 57, and the inflow control elements 30, 30' will not "disturb" or provide an obstruction to the fluid flowing into the primary flow channel 3.

From the embodiment shown in FIGS. 3*a*-3*h* it should be understood that each flow path of the secondary flow channel is configured for providing a pressure towards the inactive (i.e. left) position of the piston arrangement 20 when fluid flows through the inlets 11, 110 of the secondary flow channel, and that the bypass flow channel is configured for providing a pressure towards the active (i.e. right) position of the piston arrangement 20 when fluid flows through at least one of the inlets 31, 310 of the bypass flow channel and one of the inlets 11, 110 is closed.

The above should explain the basic feature of the valve 1 according to an embodiment of the present invention wherein the valve 1 is configured for opening "on the fly" after being closed.

In what follows, the invention will be explained in more details.

Figure 4B:
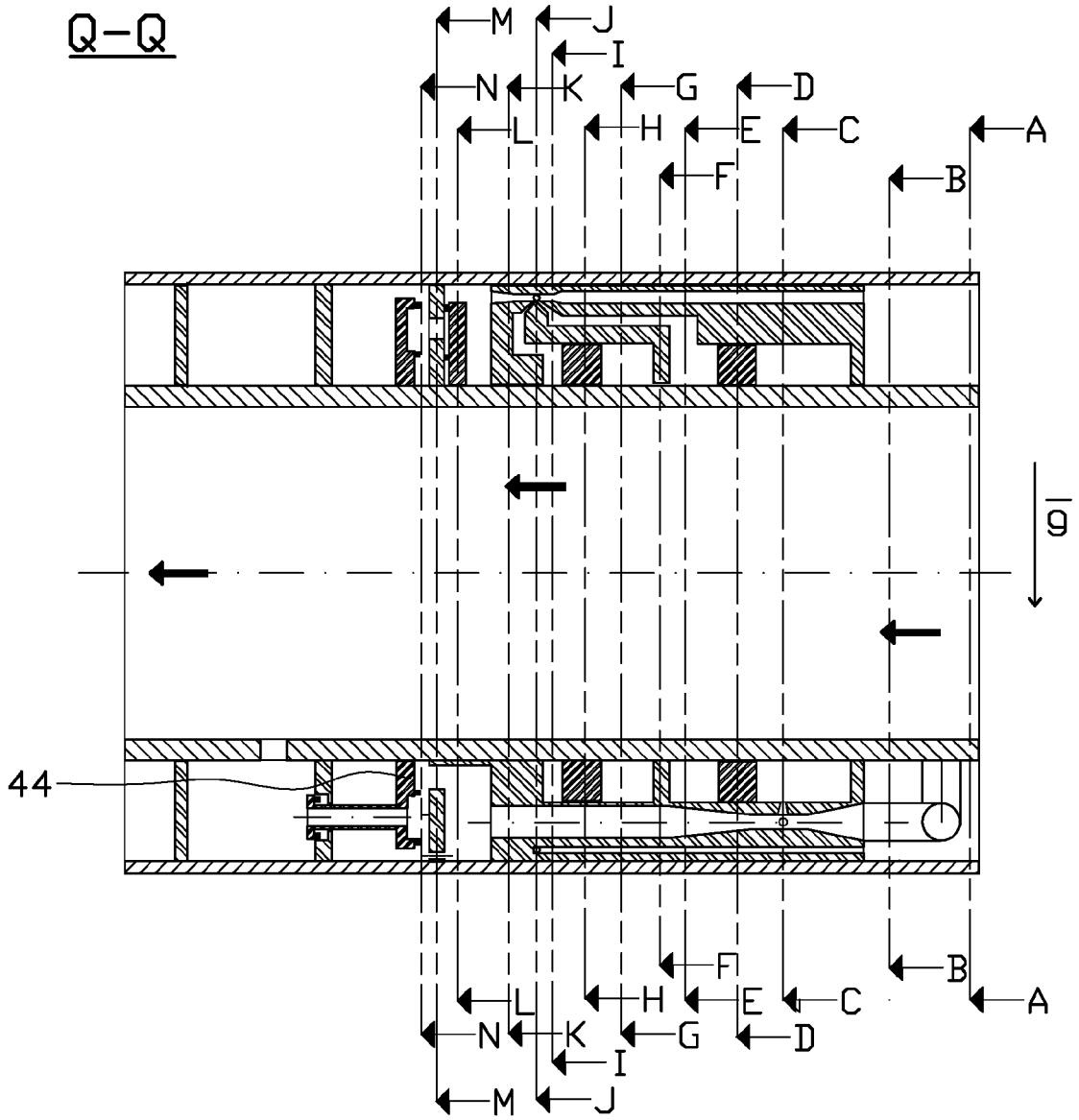
FIG. 4*b* shows the same as FIG. 4*a*, indicating positions of various cross-sections through the valve which are shown in FIGS. 4*d*-4*q;*
Figure 4C:
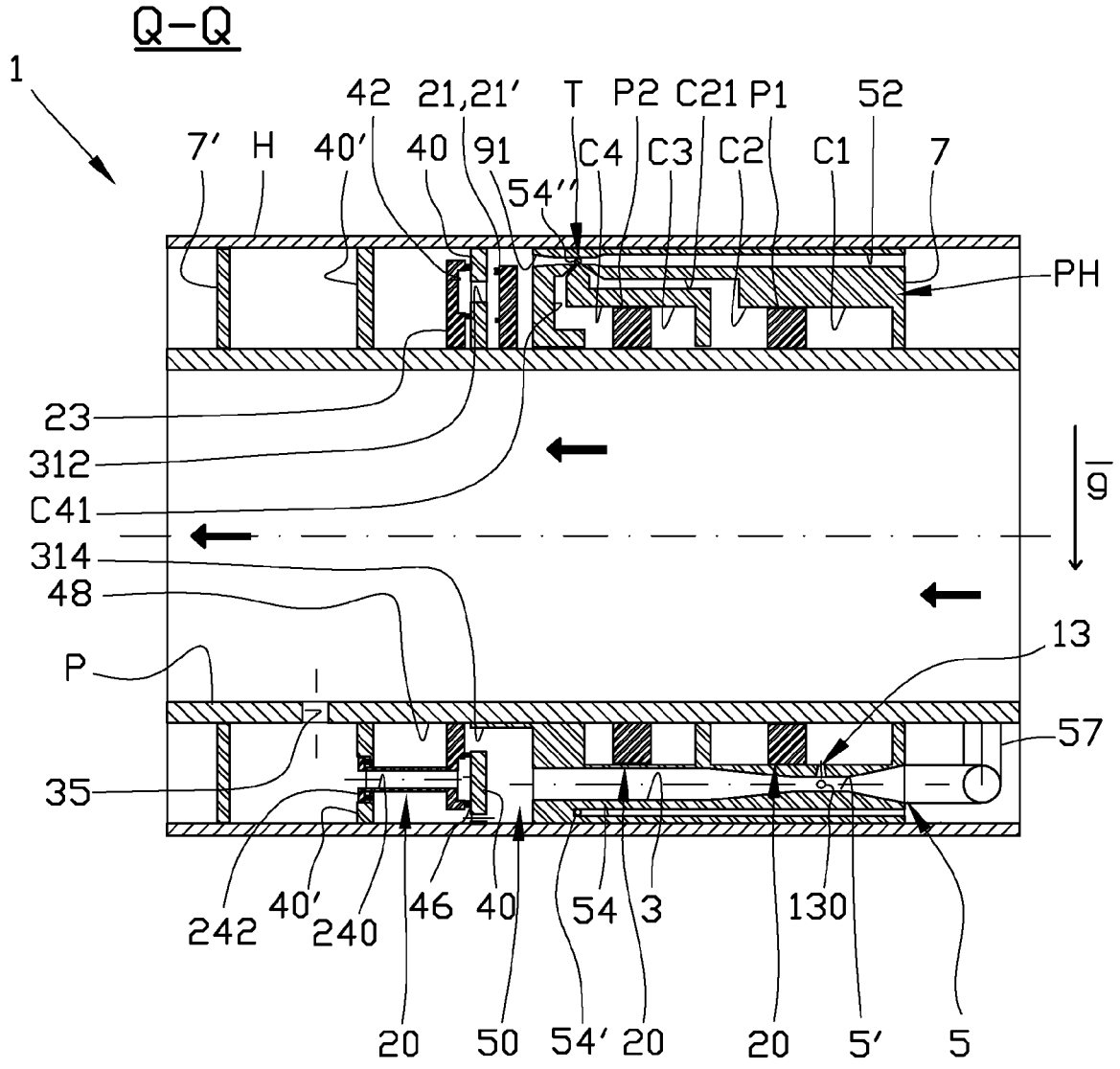
FIG. 4*c* shows the valve in FIG. 4*a* when the valve is in a closed position.
Figure 4D:
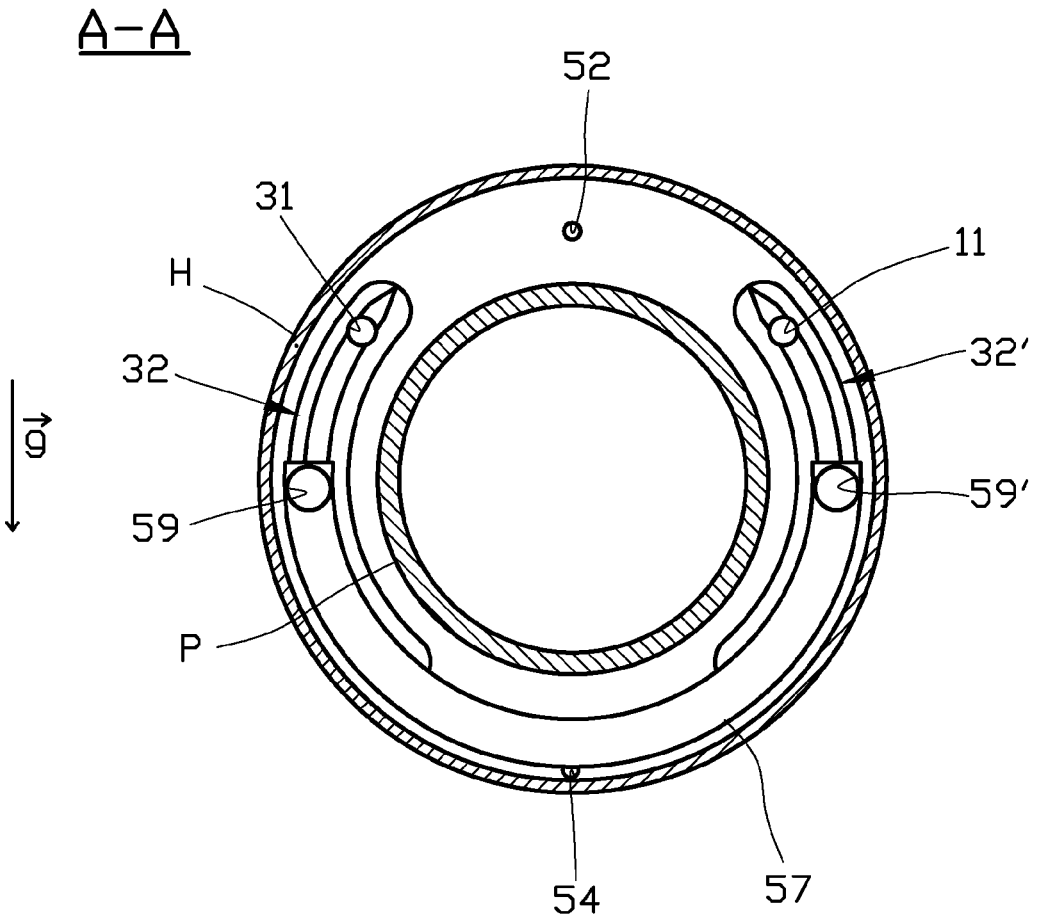
FIG. 4*d* shows a cross-section through A-A of FIG. 4*b;*
Figure 4E:
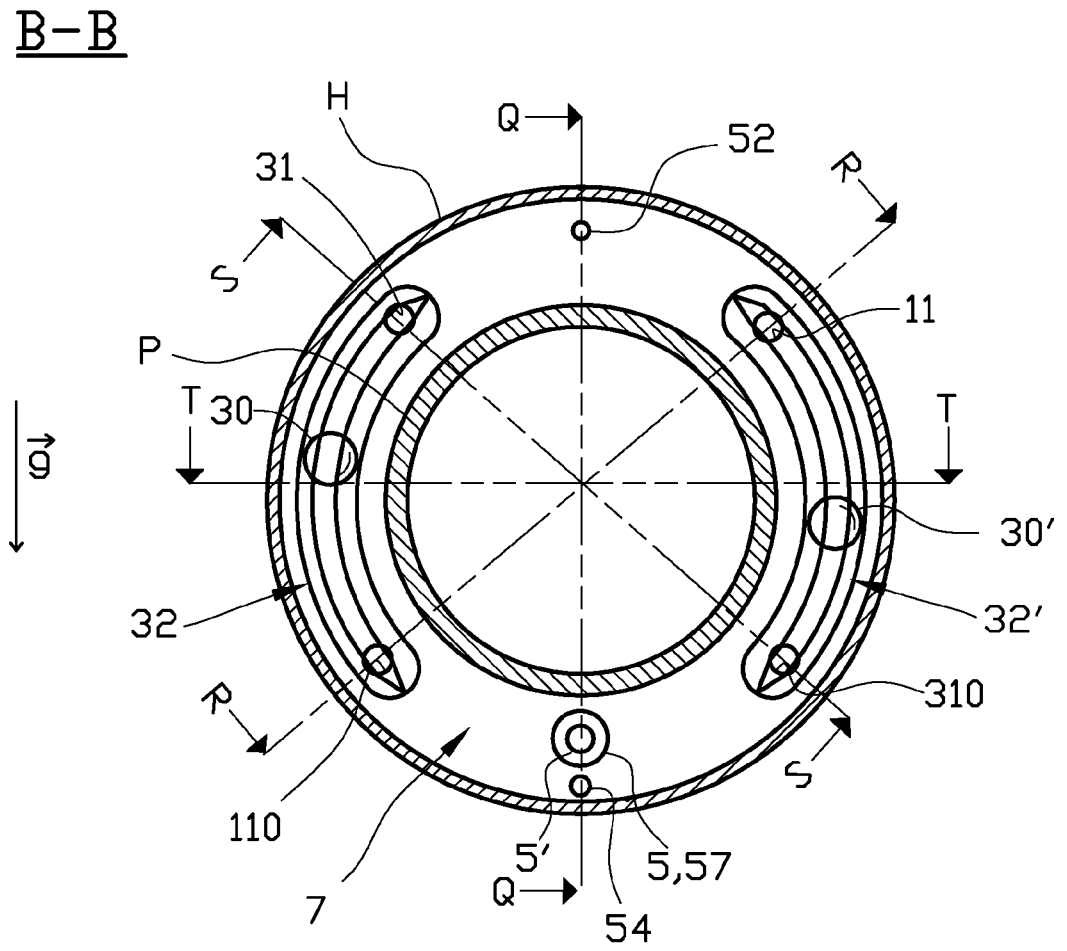
FIG. 4*e* shows a cross-section through B-B of FIG. 4*b;*
Figure 4F:
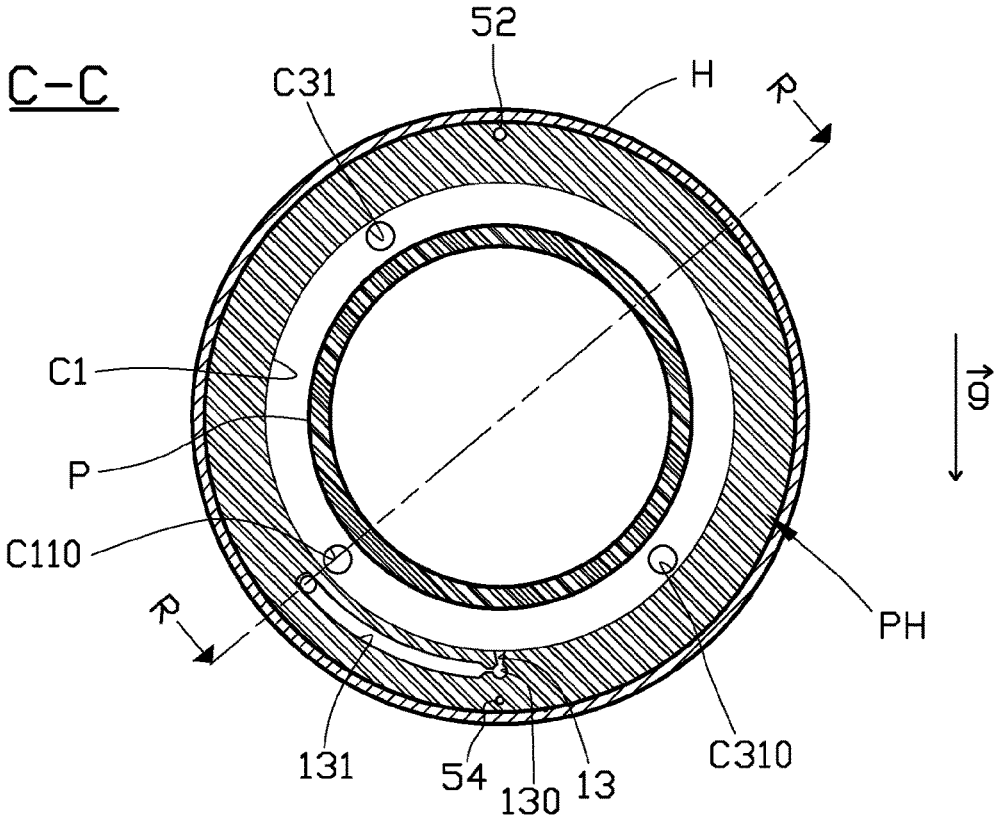
FIG. 4*f* shows a cross-section through C-C of FIG. 4*b;*
Figure 4G:
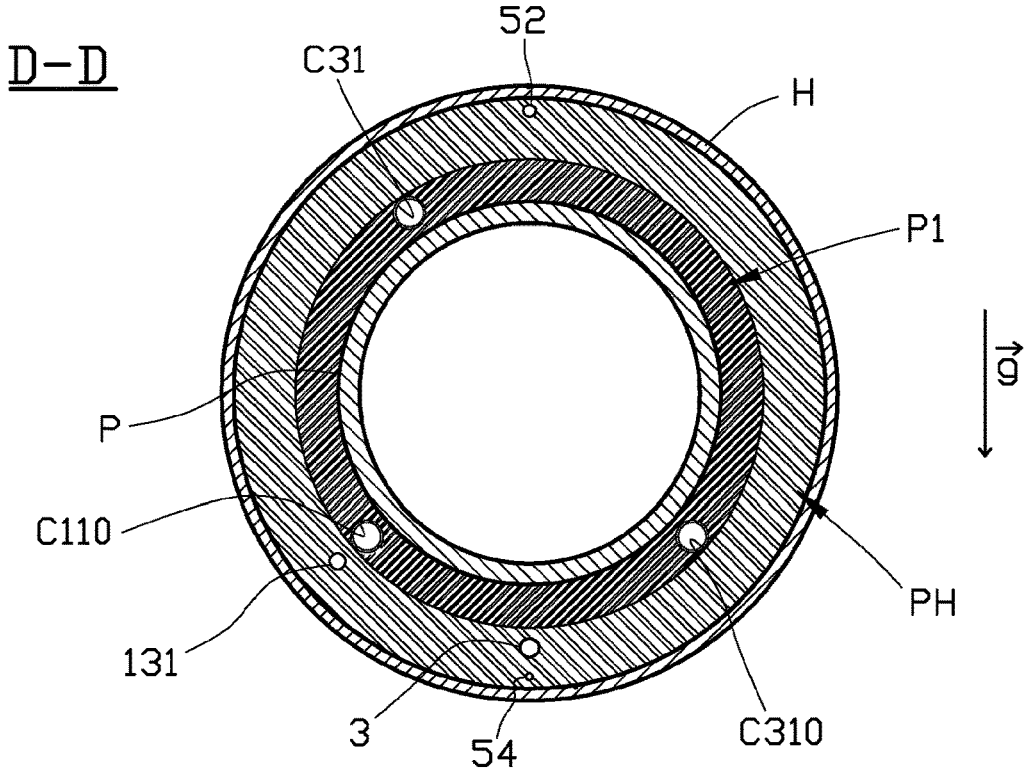
FIG. 4*g* shows a cross-section through D-D of FIG. 4*b;*
Figure 4H:
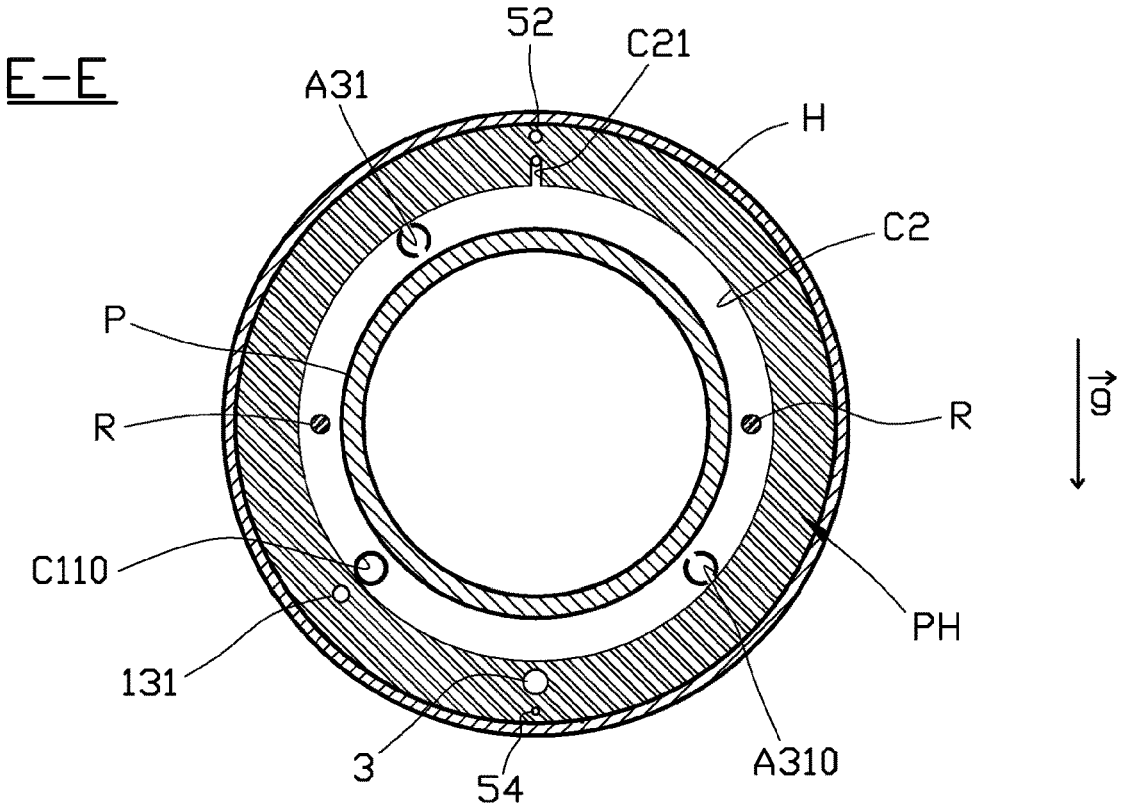
FIG. 4*h* shows a cross-section through E-E of FIG. 4*b;*
Figure 4I:
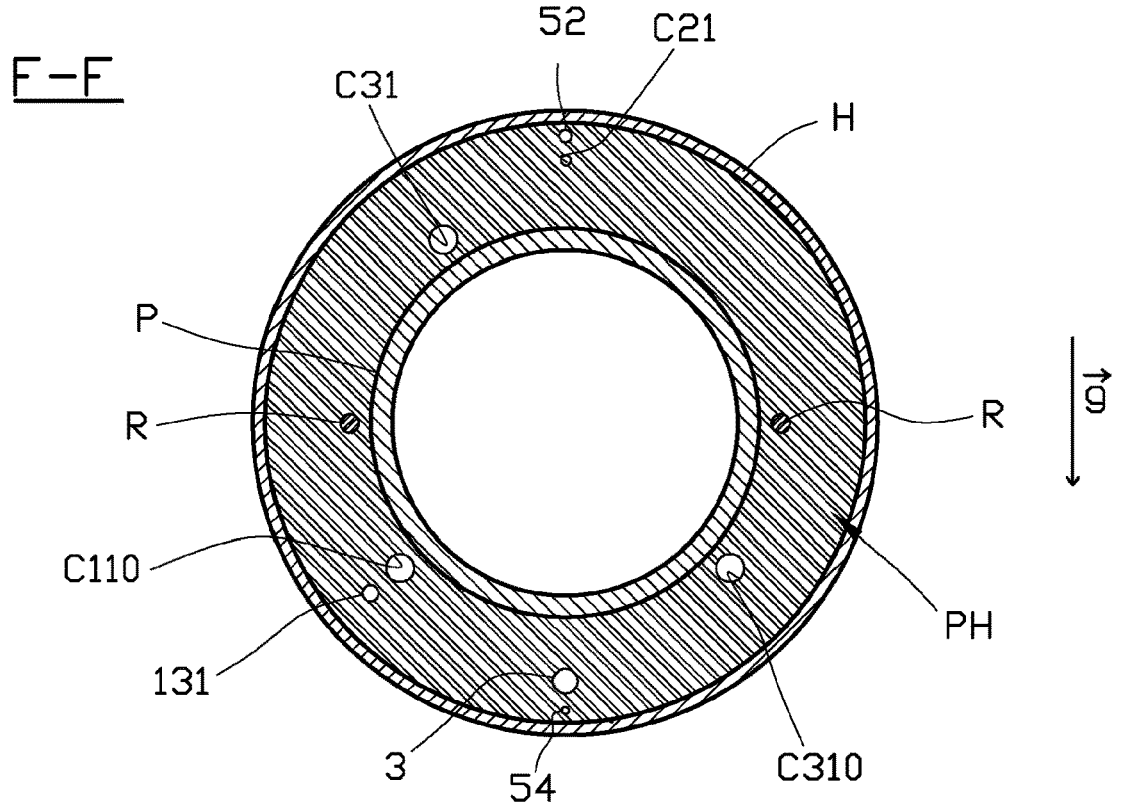
FIG. 4*i* shows a cross-section through F-F of FIG. 4*b;*
Figure 4J:
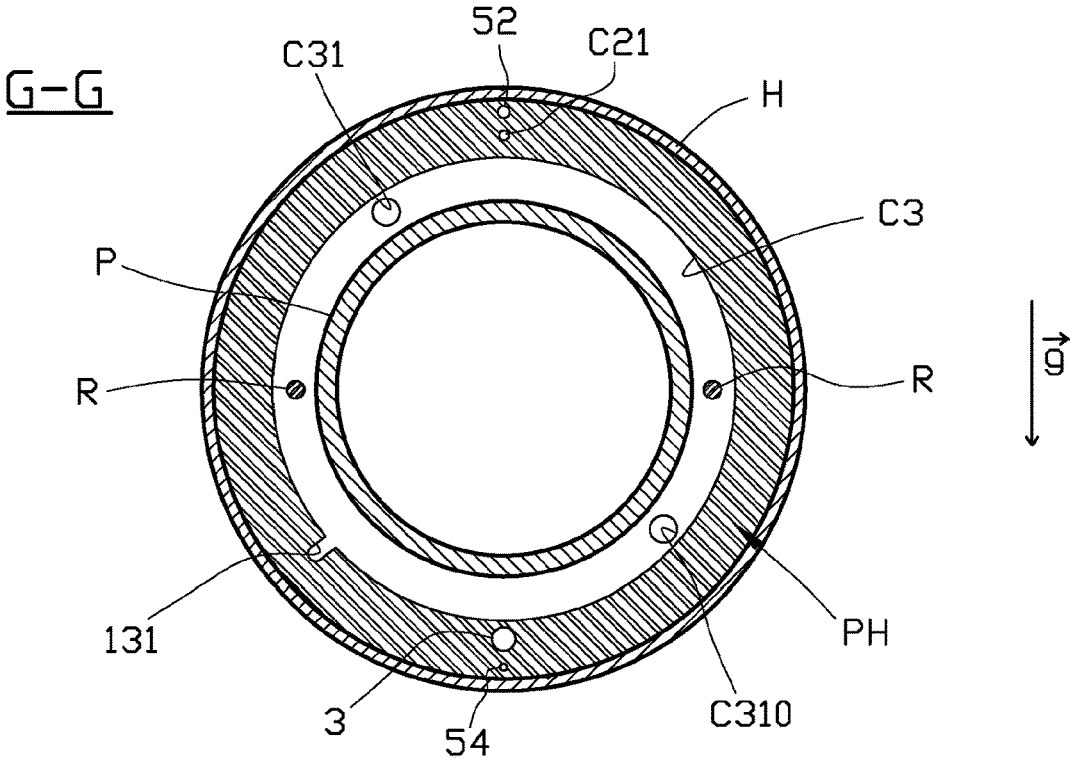
FIG. 4*j* shows a cross-section through G-G of FIG. 4*b;*
Figure 4K:
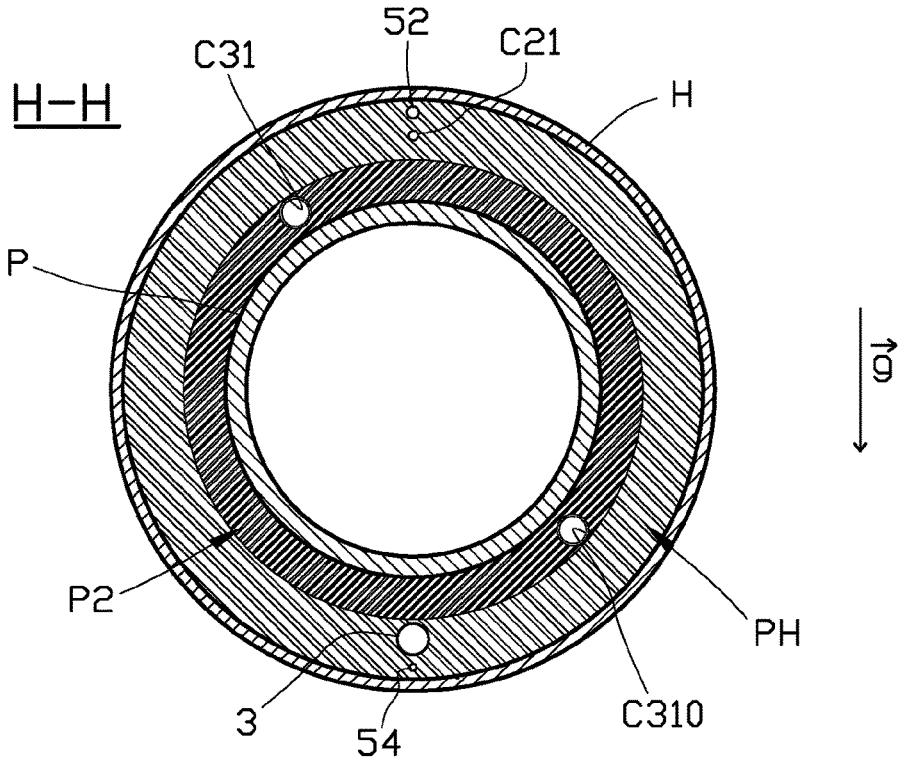
FIG. 4*k* shows a cross-section through H-H of FIG. 4*b;*
Figure 4L:
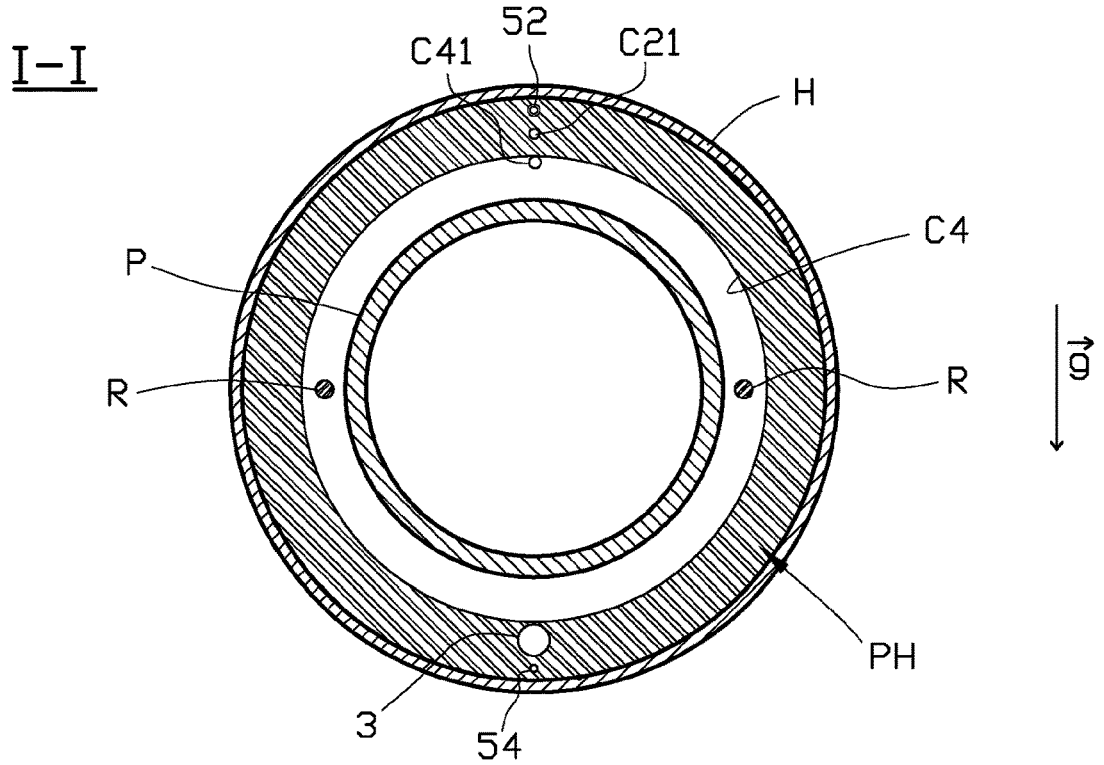
FIG. 4*l* shows a cross-section through I-I of FIG. 4*b;*
Figure 4M:
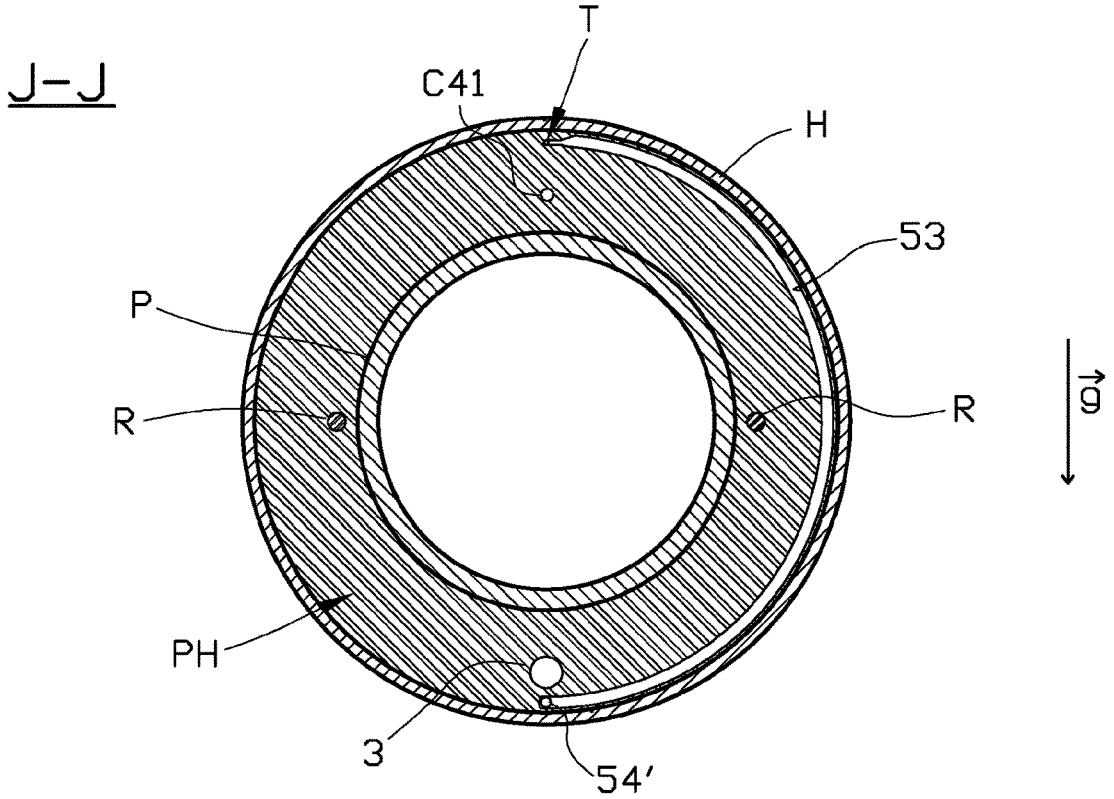
FIG. 4*m* shows a cross-section through J-J of FIG. 4*b;*
Figure 4N:
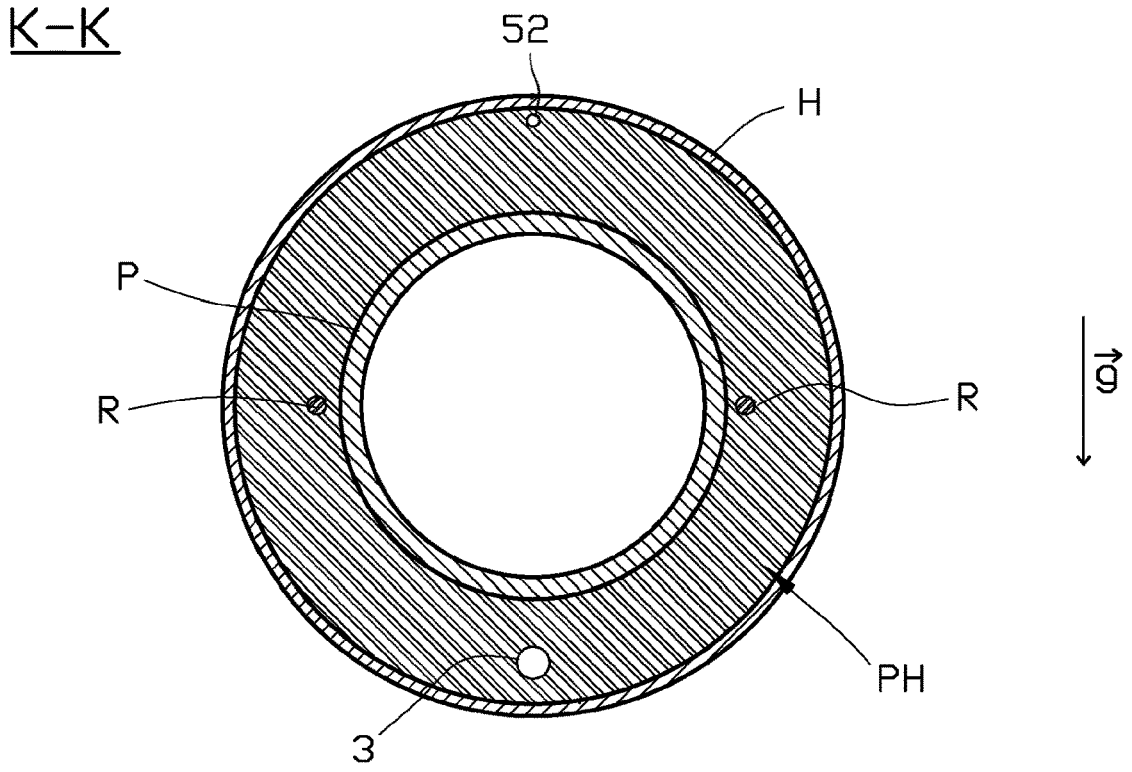
FIG. 4*n* shows a cross-section through K-K of FIG. 4*b;*
Figure 4O:
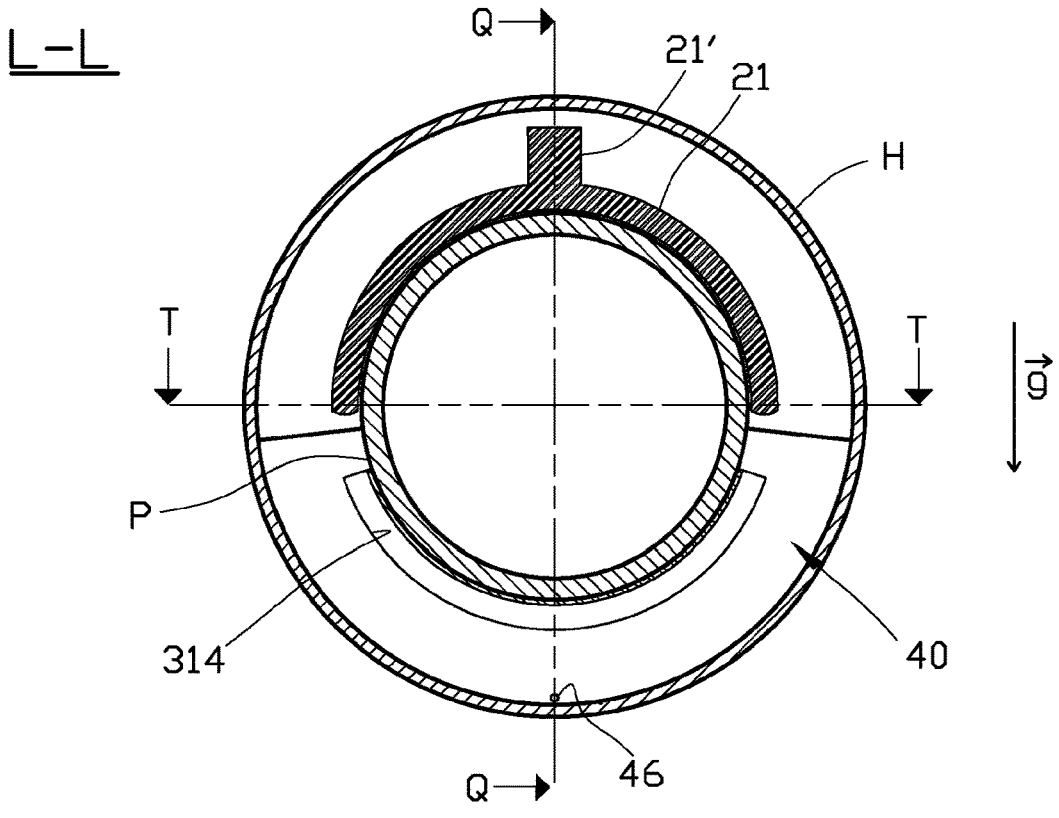
FIG. 4*o* shows a cross-section through L-L of FIG. 4*b;*
Figure 4P:
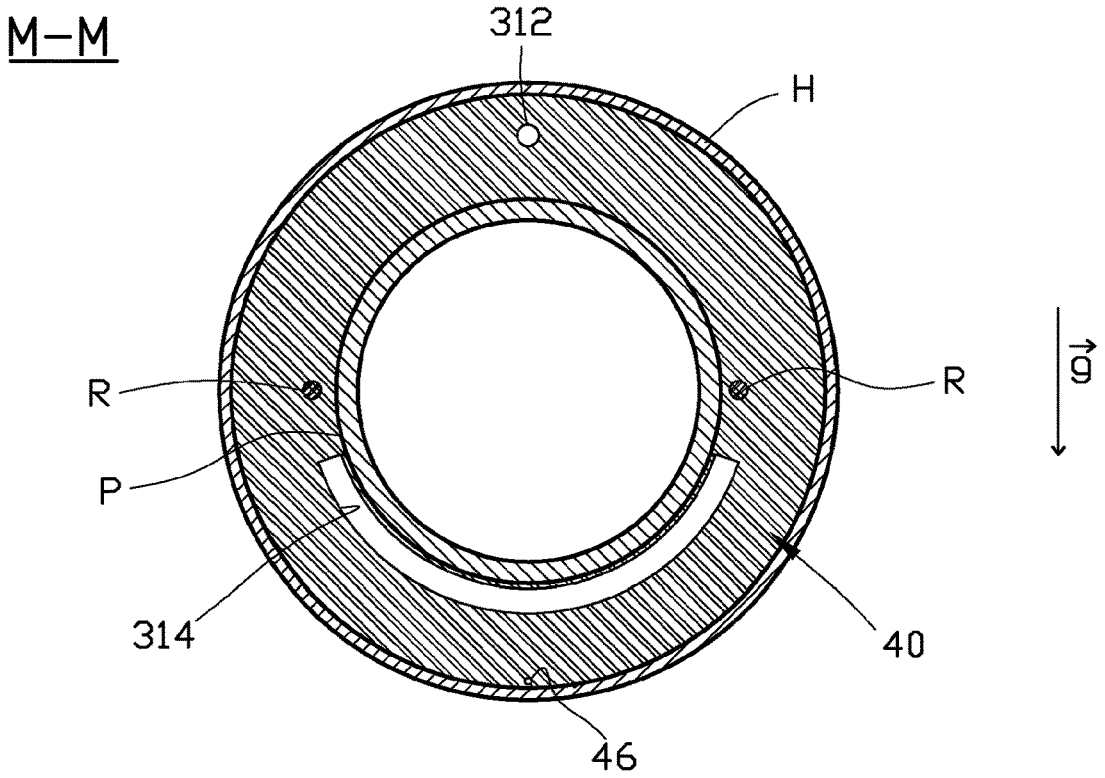
FIG. 4*p* shows a cross-section through M-M of FIG. 4*b;*
Figure 4Q:
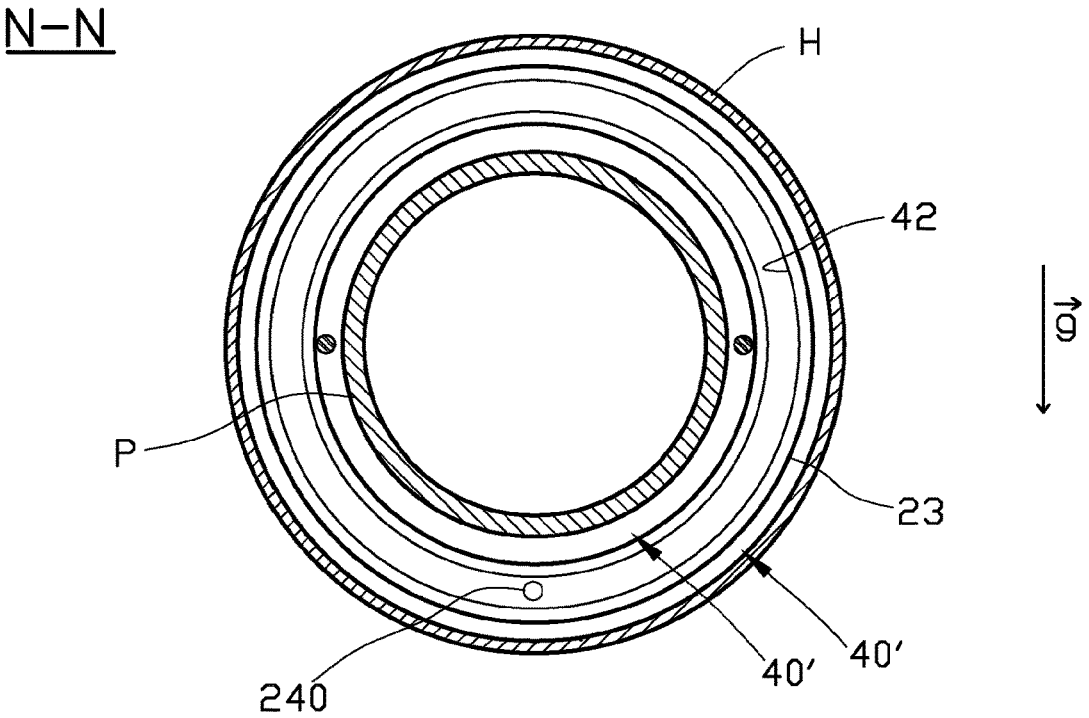
FIG. 4*q* shows a cross-section through N-N of FIG. 4*b;*

FIGS. 4*a*-4*q* show an example of a valve 1 according to the present invention configured for closing for undesired fluids such as for example water and gas, and to reopen when a desired fluid, such as for example oil comes back. The valve 1 comprises similar elements as discussed above with regards to FIGS. 3*a*-3*h*. Some of the elements already discussed in FIGS. 3*a*-3*h* may therefore not be thoroughly discussed in what follows.

The valve 1 is designed for closing inflow of a fluid from the well W shown in FIG. 1. The valve 1 may typically be arranged as shown in principle in FIG. 2. In the embodiment shown in FIG. 4*a*, the valve 1 is in an open position and configured for blocking inflow of undesired fluids in the form of water and gas exceeding a predetermined level. As indicated above, undesired water and undesired gas will not occur simultaneously. FIG. 4*c* shows the valve 1 when closed.

The valve 1 is arranged in an annular space defined between an inner barrel P, such as for example a basepipe that may form part of or be connected to a production string PS of a petroleum well W (see FIG. 1), an outer housing H enclosing a portion of the inner barrel P, an upstream barrier 7 and a downstream barrier 7'.

The barrel P is provided with an aperture 35 for allowing fluid communication from the valve 1 and into the production string PS (as shown in FIGS. 1 and 2). The aperture 35 is arranged upstream of the downstream barrier 7' and downstream of the piston arrangement 20.

The valve 1 shown in FIGS. 4*a*-4*q* comprises an annular piston arrangement 20 axially movable between a first position and a second position. The axial movement of the piston arrangement 20 is limited by a first valve seat 40 and a second valve seat 40' as will be explained below.

FIG. 4*a* shows an axial cross-section taken along a longitudinal direction of the valve 1 in an open position, i.e. with the piston arrangement in an inactive position. It should be noted that FIG. 4*a* is a cross-section through Q-Q of FIG. 4*e*.

FIG. 4*b* shows the same as FIG. 4*a*, but without reference numerals. The purpose of FIG. 4*b* is to indicate positions of various cross-sections shown in FIGS. 4*d*-4*q*.

Figure 8:
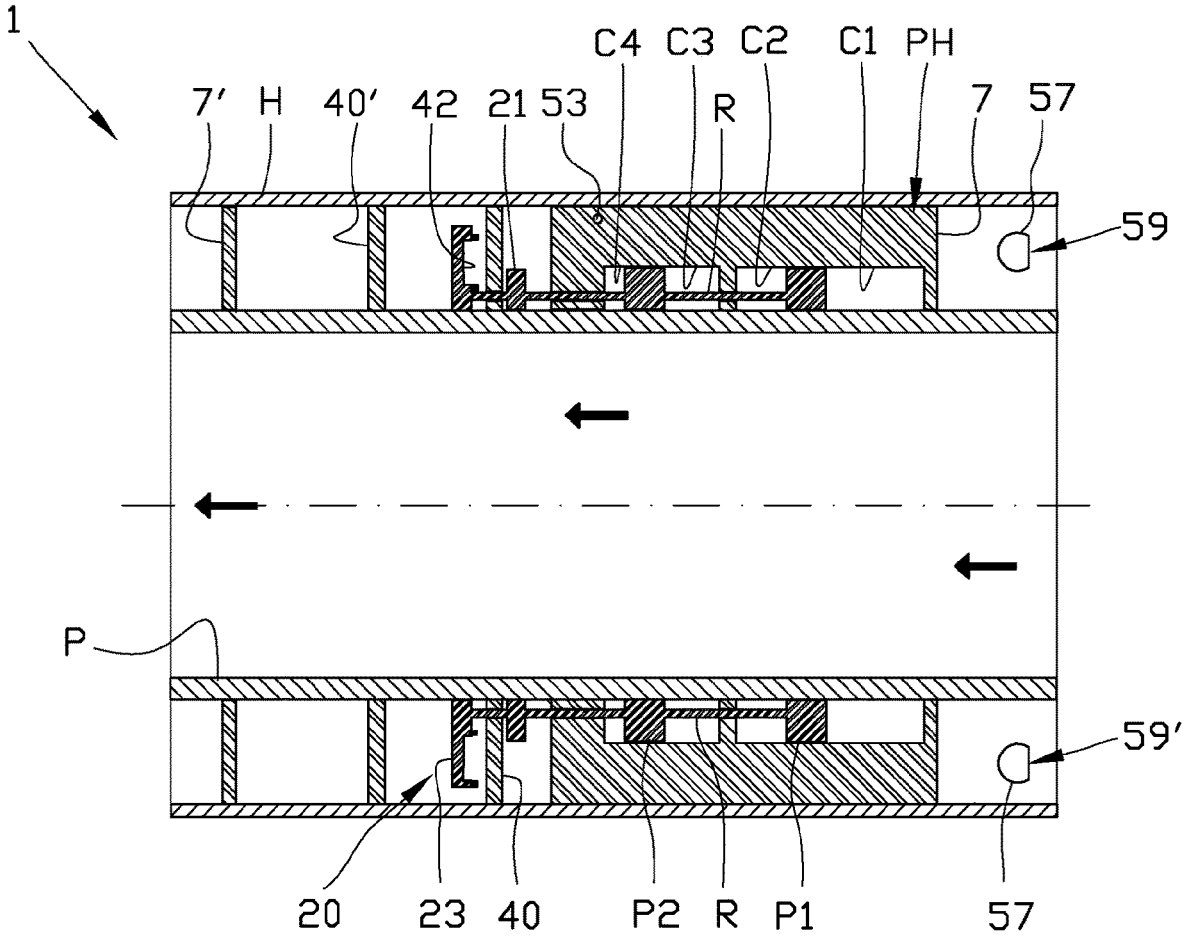
FIG. 8 shows a cross-section through T-T of FIG. 4*e*.

FIG. 4*c* shows the valve in FIG. 4*a* with the piston arrangement 20 in an active or closed position. The piston arrangement 20 comprises a first piston P1 forming an axially movable wall between a first piston chamber C1 and a second piston chamber C2, and a second piston P2 forming an axially movable wall between a third piston chamber C3 and a fourth piston chamber C4. The pistons P1 and P2 are interconnected by means of rods R as best seen in FIG. 8.

Figure 6:
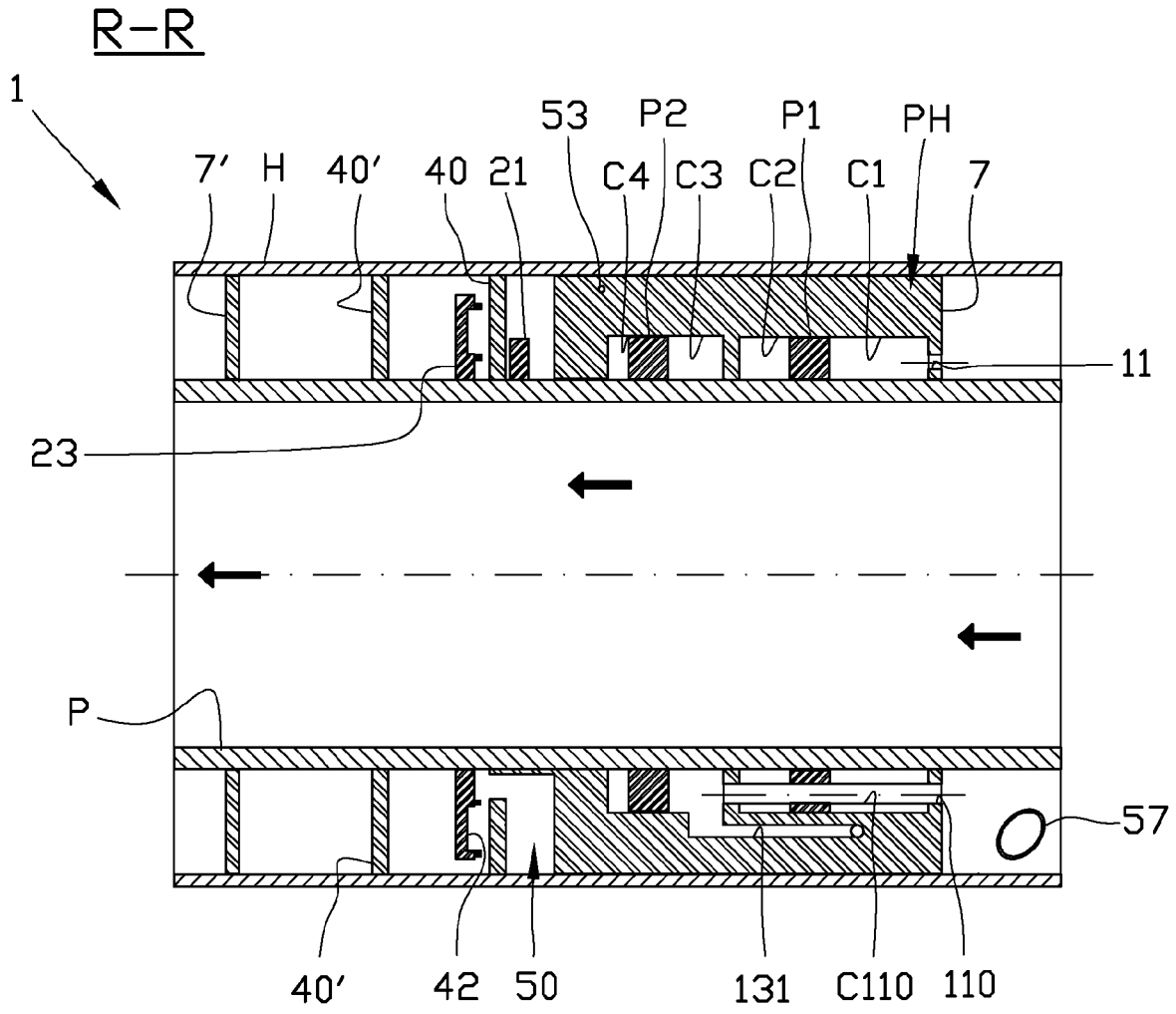
FIG. 6 shows a cross-section through R-R of FIG. 4*e;*
Figure 7:
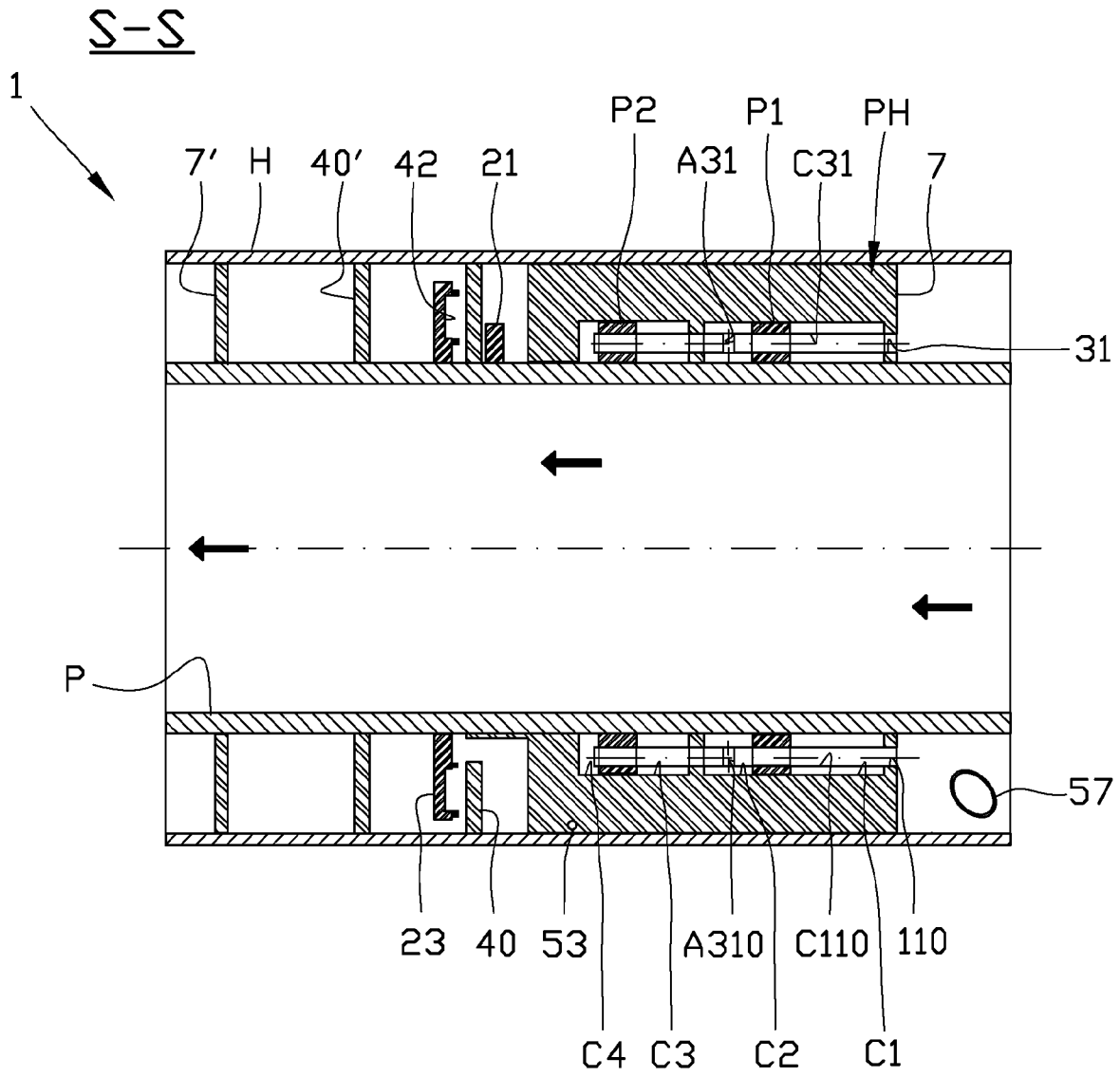
FIG. 7 shows a cross-section through S-S of FIG. 4*e;*

As discussed in relation to FIGS. 3*a*-3*h*, and as shown in FIGS. 6 and 7, the piston chambers C1, C2, C3 and C4 are in fluid communication with respective ones of inlets 11, 31, 310 and 110 through the restriction 7.

The piston arrangement 20 comprises a bypass channel closing element 21 and a primary channel closing element 23.

In an inactive or open position of the piston arrangement 20, the bypass channel closing element 21 is configured for closing a bypass channel outlet 312 arranged in a top portion of the first valve seat element 40.

In a lower portion, the first valve seat element 40 is provided with a slit 314 extending along an outside portion of the inner barrel P. The oblong slit 314 is best seen in FIG. 4*o* and FIG. 4*p*. The slit 314 provides a fluid path for fluid flowing from the primary flow channel 3 when the piston arrangement 20 is in its inactive or open position.

The valve 1 is provided with a pressure-controlled mechanism for providing a pressure differential across a portion of the piston arrangement 20 when the piston arrangement 20 abuts the first valve seat 40. The pressure-controlled mechanism is responsive to a difference in fluid pressure upstream and downstream of the valve 1, so that a closing force of the valve 1 is added to the piston arrangement 20 when said difference in fluid pressure is positive. One purpose of the pressure-controlled mechanism is to facilitate in keeping the valve 1 closed. Another purpose is to facilitate reopening of the valve 1.

In the embodiment shown in FIG. 4*a*, the pressure-controlled mechanism comprises an annular cavity 42 formed in a portion of the primary channel closing element 23 facing the first valve seat 40. However, it should be clear that the annular cavity 42 in an alternative embodiment could be formed in both the primary channel closing element 23 and the first valve seat 40, or in the first valve seat 40 only. The point is to create an annular cavity 42 between the first valve seat 40 and the primary channel closing element 23 when abutting each other.

The annular cavity 42 is in fluid communication with the aperture 35 in the barrel P via a piston conduit 240 protruding in an axial downstream direction from the primary channel closing element 23. The piston conduit 240 extends through an aperture in the second valve seat element 40'.

When the piston arrangement 20 is in its active or closed position as shown in FIG. 4*c*, a distant end portion 242 of the piston conduit 240 abuts a periphery of the aperture in the second valve seat element 40'. As indicated in FIG. 4*a*-4*c*, the distant end portion 242 is provided with a sealing element.

The first valve seat element 40 is further provided with a pressure communication channel 46 for providing fluid communication between the primary flow channel 3 and an annular conduit chamber 48 defined by the barrel P, the housing H, the second valve seat element 40', the primary channel closing element 23 and a portion of the first valve seat element 40.

The purpose of the piston conduit 240 is to provide a pressure within the cavity 42 that is lower than the pressure within the conduit chamber 48. Such a pressure differential will arise due to the fact that the cavity 42 is in fluid communication with the fluid flowing within the barrel P, while the fluid pressure within the conduit chamber 48 is in fluid communication with the high-pressure fluid at the inlet 5 of the valve 1. Thus, the pressure differential will result in a net pressure force on the piston arrangement 20 in an upstream direction, which increases the pressure toward the first valve seat element 40 and the second valve seat element 40'.

The annular cavity 42 in the primary flow channel closing element 23 provides a conduit 44 (indicated by a dotted line in FIGS. 3*a*-3*h*) for allowing a fluid communication from the bypass channel outlet 312 to the outlet of the distant end portion 242 of the piston conduit 240 when the piston arrangement 20 is in its active or closed position.

The purpose of the annular cavity 42 (providing conduit 44) is to provide a leakage that will make the valve 1 capable of re-opening if gas or water for example in a near-wellbore region retreats and is replaced by oil.

In the embodiment shown, the valve 1 further comprises a first leakage channel 52 and a second leakage channel 54. The first leakage channel 52 is provided with a vena contracta for providing an underpressure therein. The vena contracta is provided at the tee T, as indicated in FIGS. 4*a*-4*c*.

The second leakage channel 54 is in fluid communication with the first leakage channel 52 via a conduit 53 (see FIG. 4*m*) having a leakage conduit inlet 54' at an end portion of the second leakage channel 54 and a leakage channel outlet in a vena contracta portion of the first leakage channel 52. As mentioned above in connection with FIGS. 3*a*-3*g*, a channel C21 from the second piston chamber C2 and a channel C41 from the fourth piston chamber 41 merge at the vena contracta of the first leakage channel 52, i.e. at the tee T.

As indicated in FIGS. 4*a* and 4*c*, the secondary flow channel outlet or pilot hole 13 is provided with a funnel-shaped inlet portion. Such an inlet portion is favourable as the effective flow area then becomes substantially the same as the smallest cross-section of the secondary outlet 13. A discharge coefficient of the secondary outlet 13 (the pilot hole) will then be close to one, thereby removing its sensitivity to Reynolds number. The pilot hole 13 provides fluid communication between the first piston chamber C1 and the primary flow channel 3.

In the vena contracta 5' of the primary flow channel 3 there is provided an inlet 130 of a conduit 131 (see FIGS. 4*f* and 6) for providing fluid communication between the primary flow channel 3 and the third piston chamber C3. The inlet 130 will also be denoted a pilot hole 130.

The inlet 5 of the primary flow channel 3 is connected to an inlet tube 57 having, in a position of use, an inlet arranged at a higher elevation than the elevation of the primary flow channel. This has an effect of allowing a closing of the valve for both the first and second undesired fluids, such as for example water in one situation and gas in another situation. The arrangement of the inlet tube 57 is shown in FIG. 4*d* which will now be discussed.

FIG. 4*d* is a cross-sectional view through A-A of FIG. 4*b*, i.e. taken upstream of the inlet tube 57. In the embodiment shown, the inlet tube 57 is provided with two inlets 59, 59' arranged at an elevation being lower than the secondary flow channel first inlet 11 and the bypass channel first inlet 31, but higher than the secondary flow channel second inlet 110 and the bypass channel second inlet 310, both of which are hidden behind the inlet tube 57 in FIG. 4*d*. Various views of the inlet tube 57 itself are shown in larger scale in FIGS. 5*a*-5*c*.

In the embodiment shown in FIG. 4*d*, the first inflow control element or light ball 30 and the second inflow control element or heavy ball 30' are not shown. Thus, the light ball 30 and heavy ball 30' may be at the secondary flow channel second inlet 110 and the bypass channel second inlet 310, meaning that the piston arrangement 20 is in its active position blocking for gas exceeding a predetermined level.

FIG. 4*e* is a cross-sectional view through B-B of FIG. 4*b*, i.e. taken upstream of the barrier 7 and downstream of a vertical portion of the inlet tube 57. For an illustrative purpose, the light ball 30 and the heavy ball 30' are shown at a position being within the paths 32, 32', respectively, between the bypass channel first inlet 31 and secondary flow channel second inlet 110, and the secondary flow channel first inlet 11 and bypass channel second inlet 310. The inlets of the first leakage channel 52 and second leakage channel 54 are also shown, as well as the primary flow channel inlet 5 provided by the inlet tube, and the vena contracta portion 5' of the primary flow channel 3.

FIG. 4*f* is a cross-sectional view through C-C of FIG. 4*b*. This figure shows a third piston chamber channel C110 for providing fluid communication between the secondary flow channel second inlet 110 and the third piston chamber C3, a second piston chamber channel C31 for providing fluid communication between the bypass channel first inlet 31 and the second and fourth piston chambers C2, C4, and a fourth piston chamber channel C310 for providing fluid communication between the bypass channel second inlet 310 and the second and fourth piston chambers C2, C4. Aperture A31 for providing said fluid communication between the second piston chamber channel C31 and the second piston chamber C2, and aperture A310 for providing said fluid communication between the fourth piston chamber channel C310 and the second piston chamber C2, are shown in FIGS. 3*a*-3*g* and in FIG. 4*h*.

FIG. 4*f* further shows the pilot hole 13 providing fluid communication between the first piston chamber C1 and the primary flow channel 3, and conduit 131 and inlet 130 for providing fluid communication between the primary flow channel 3 and the third piston chamber C3. Thus, the inlet 130 is also a pilot hole into the primary flow channel 3. Preferably, the inlet 130 at the vena contracta 5' is independent of the pilot hole 13 at the vena contracta 5', but the pilot holes 13, 130 have a common outlet pressure which is the pressure in the vena contracta 5'. The independency of the pilot holes 13, 130 facilitates a tailormade design for achieving a desired closing-water fraction and closing-gas fraction being independent of each other. In an embodiment wherein for example such an independent design is not required, the two pilot holes may alternatively be interconnected prior to entering the vena contracta 5'.

FIG. 4*g* is a cross-sectional view through D-D of FIG. 4*b* and shows i.a. the piston chamber channels C110, C31 and C310 discussed above in relation to FIG. 4*f*.

FIG. 4*h* is a cross-sectional view through E-E of FIG. 4*b* and shows i.a. two rods R connecting the first piston P1 with the second piston P2 so that pistons P1, P2 are interconnected. The arrangement of the rods R is best seen in FIG. 8. The rods R are also shown in principle in FIGS. 3*a*-3*h*, but there as three separate rods. In FIG. 4*h* is also shown the apertures A31, A310 mentioned above in connection with FIG. 4*f*. The rods R further connect the pistons P1, P2 with the bypass channel closing element 21 and the primary channel closing element 23', as shown in FIGS. 4*i*, 4*j*, 4*l*-4*n*, 4*p* and 4*q*.

In FIG. 4*h* is also shown the channel C21 from the second piston chamber C2.

FIG. 4*i* is a cross-sectional view through F-F of FIG. 4*b* and shows i.a. the second piston chamber channel C31 and the fourth piston chamber channel C310.

FIG. 4*j* is a cross-sectional view through G-G of FIG. 4*b* and shows i.a. the conduit 131 (as best seen in FIGS. 4*f* and 6) being in fluid communication with the third piston chamber C3.

FIG. 4*k* is a cross-sectional view through H-H of FIG. 4*b* and shows i.a. the second piston P2 and the second piston chamber channel C31 and fourth piston chamber channel C310 extending therethrough.

FIG. 4*l* is a cross-sectional view through Hof FIG. 4*b* and shows i.a. the vena contracta portion of the first leakage channel 52 and the channels C21 and C41 providing fluid communication between the second piston chamber C2 and the fourth piston chamber C4, respectively, with the bypass channel outlet 91 shown in FIGS. 4*a*-4*c*.

FIG. 4*m* is a cross-sectional view through J-J of FIG. 4*b* and shows i.a. the conduit 53 providing fluid communication between the second leakage channel 54 and the first leakage channel 52. The conduit 53 is provided in a portion of the piston housing PH. It should be noted that the conduit 53 is provided with a restriction at the merging point at the vena contracta portion of the first leakage channel 52, i.e. at the tee T.

FIG. 4*n* is a cross-sectional view through K-K of FIG. 4*b* and shows i.a. the rods R for connecting the second piston P2 with the bypass channel closing element 21, extending through the piston housing PH.

FIG. 4*o* is a cross-sectional view through L-L of FIG. 4*b* and shows i.a. the bypass channel closing element 21 of the piston arrangement 20. The bypass channel closing element 21 is provided with a protrusion 21' for blocking the bypass channel outlet 312. The bypass channel closing element 21 is in the embodiment shown arranged substantially within an upper half of the valve 1. It should be clear that there is no fluid communication between the upper half and a lower half of the valve 1 at L-L.

FIG. 4*p* is a cross-sectional view through M-M of FIG. 4*b* and shows the bypass channel outlet 312 forming an aperture through the first valve seat 40. The first valve seat 40 is in the form of an annular wall 40 protruding from an inner surface of the housing H. The oblong slit 314 mentioned above forms an opening through the first valve seat 40. Said opening provides a fluid path for fluid flowing from the primary flow channel 3 when the piston arrangement 20 is in its inactive position wherein the bypass channel outlet 312 is closed by the protrusion 21' of the bypass channel closing element 21. In a lower portion of the first valve seat element 40 there is provided a pressure communication channel 46 for providing pressure communication between the primary flow channel 3 and an annular conduit chamber 48 (see FIG. 4*a*) defined by the barrel P, the housing H, the second valve seat element 40', the primary channel closing element 23 and a portion of the first valve seat element 40. The purpose of the pressure communication channel 46 is to provide an added closing force to the piston arrangement 20 when the valve 1 is closed, i.e. when the piston arrangement 20 is in its active position.

FIG. 4*q* is a cross-sectional view through N-N of FIG. 4*b* and shows i.a. the annular cavity 42 formed in the primary channel closing element 23. In a lower portion, the annular cavity 42 is provided with the piston conduit 240 for providing fluid communication with the aperture 35 in the barrel P (see for example FIGS. 4*a*-4*c*).

Figure 5A:
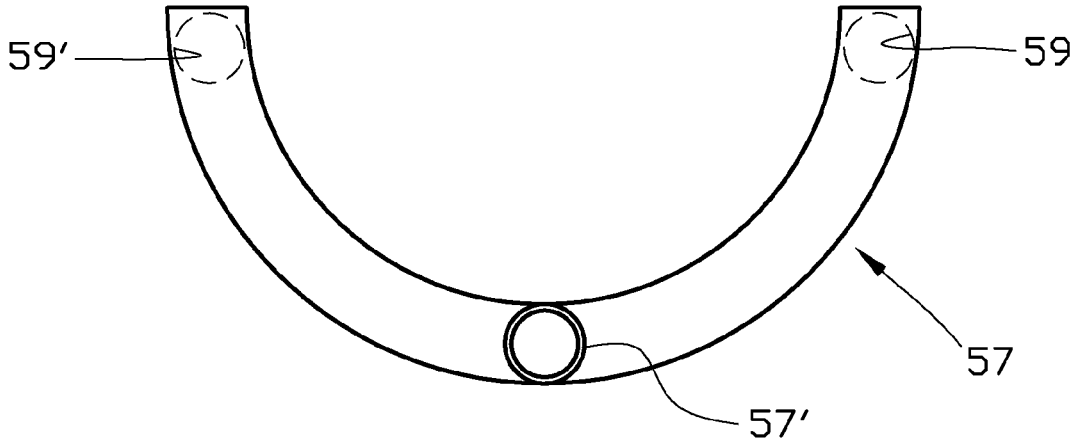
FIGS. 5*a*-5*c* show in a larger scale various views of an inlet tube as shown in FIG. 4*d;*
Figure 5B:
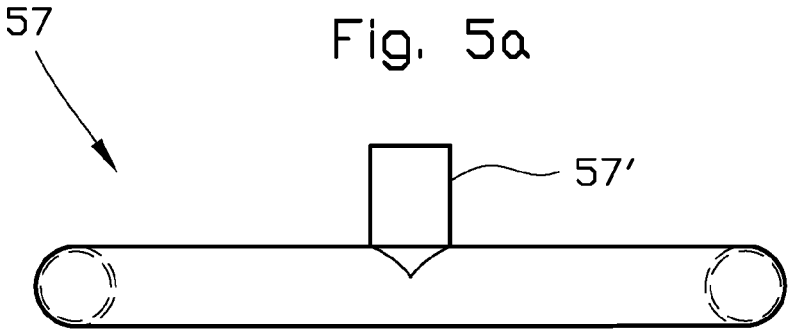
Figure 5C:
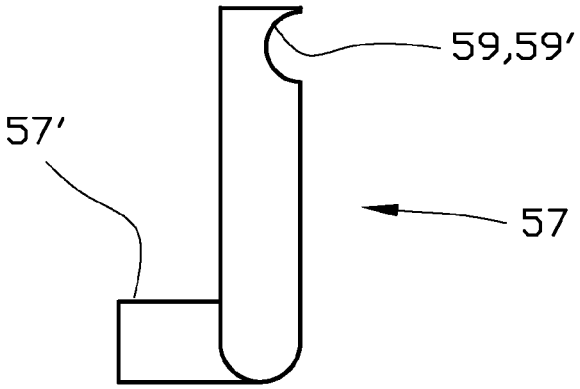

FIGS. 5*a*-5*c* shows in a larger scale various views of one embodiment of the inlet tube 57. The inlet tube is provided with two inlets 59, 59' arranged, in a position of use, at a top portion thereof, and an outlet 57' at a bottom portion thereof. The outlet 57' is configured for connection with the primary inlet 5 of the primary flow channel 3 as shown for example in FIGS. 4*a*-4*c*. FIG. 5*a* is seen in an upstream direction, i.e. from left to right through cross-section B-B in FIG. 4*b*. A top view of the inlet tube 57 is shown in FIG. 5*b*, while FIG. 5*c* is a side view of the inlet tube 57.

FIG. 6 is an axial cross-sectional view through R-R of FIG. 4*e* (and FIG. 4*f*) and shows i.a. the third piston chamber channel C110 providing fluid communication between the secondary flow channel second inlet 110 and the third piston chamber C3. Further, FIG. 6 shows the conduit 131 for providing fluid communication between the third piston chamber C3 and the inlet or pilot hole 130 in the primary flow channel 3. As mentioned above, the inlet 130 is preferably independent of the pilot hole 13 providing fluid communication between the first piston chamber C1 and the primary flow channel 3.

FIG. 7 is an axial cross-sectional view through S-S of FIG. 4*e* and shows i.a. the bypass channel first inlet 31 and the bypass channel second inlet 310 being in fluid communication with the fourth piston chamber C4 by means of the second piston chamber channel C31 and the fourth piston chamber channel C310, respectively. By means of the apertures A31 and A310, the second piston chamber channel C31 and the fourth piston chamber channel C310 are also in fluid communication with the second piston chamber C2.

FIG. 8 is an axial cross-sectional view through T-T of FIG. 4*e* and shows i.a. the rods R connecting the first piston P1 to the second piston P2, the second piston P2 to the bypass channel closing element 21, and the bypass channel closing element 21 to the primary channel closing element 23. Thus, the piston rods R provide a connection for all parts of the piston arrangement 20.

From the discussion above it will be understood that the valve 1 shown in FIGS. 4*a* to 8 is configured also for being capable of reopening after being closed, i.e. with the piston arrangement 20 being in its active position. Such a reopening is of particular interest when the valve 1 is used in an oil producing well wherein undesired fluids in the form of gas and water are likely to occur throughout the lifetime of the well. The capability of reopening is due to the leakage channels 52 and 54 that provide a "draining" of the valve 1 when in an active or closed position. For example, if the valve 1 has been closed due to gas above a predetermined level, that has been flowing through the valve 1 (as shown in FIG. 4*c*) and oil is coming back, the gas is drained or urged out of the valve 1 at least via the first leakage channel 52, the bypass channel outlet 312, the annular chamber 42, the piston conduit 240 and the aperture 35 in the barrel P. Similarly, if the valve 1 has been closed due to water above a predetermined level has been flowing through the valve 1 (as shown in FIG. 4*c*) and oil is coming back, the water is drained or urged out of the valve 1 at least via the second leakage channel 54, the bypass channel outlet 312, the annular chamber 42, the piston conduit 240 and the aperture 35 in the barrel P.

From the above discussion it will also be understood that the hydraulic pressure within the four piston chambers C1, C2, C3 and C4 is high, i.e. at substantially the same pressure as the fluid upstream of the barrier 7, when the piston arrangement 20 of the valve 1 is in its inactive or active position. The piston arrangement 20 moves from its inactive position to its active position and closes the valve 1 when the hydraulic pressure within the second and fourth piston chambers C2, C4 exceeds the hydraulic pressure within one of the first and third piston chambers C1, C3. Such a situation will occur if one of the two closing elements 30, 30' moves within their respective path 32, 32' from the bypass channel first inlet 31 or bypass flow channel second inlet 310, to the secondary flow channel first inlet 11 (which is the situation when water above a predetermined level flows into the valve 1) or to the secondary flow channel second inlet 310 (which is the situation when gas above a predetermined level flows into the valve 1).

The valve 1 discussed above is configured for re-opening once the fraction of undesired fluids, such as gas and water, drops below a predetermined limit, even if there is a pressure difference across the valve.

From the above it should be clear that when the valve 1 is closed, both the first leakage channel 52 and the second leakage channel 54 provide fluid communication between the fluid upstream of the barrier 7, i.e. the inlet 5 of the valve 1, and the annular cavity 42.

In order to avoid a too high leakage flow rate through a closed valve 1, the two leakage channels 52, 54 may typically be merged into one common channel, as shown, before entering the low-pressure cavity 42 from the bypass channel outlet 312. A diameter of the merged leakage channel will determine the total leakage flow rate, whereas the diameter ratio of the first leakage channel 52, the second leakage channel 54 and other channels entering the tee T will determine the water or gas fraction below which the valve 1 re-opens. The valve 1 will normally be designed to re-open at a water or gas fraction significantly lower than the water or gas fraction where it closes in order to prevent a situation where the valve 1 continuously toggles between closed and open position. By significantly lower is meant for example 5%.

The embodiment of the present invention discussed above is an example of a design suitable for achieving the desired properties of the valve 1. However, numerous alternative designs are possible.

From the disclosure herein, a person skilled in the art will appreciate that the valve 1 according to the present invention is an AICD (Autonomous Inflow Control Device) that operates independently of fluid viscosity, flow rate and Reynolds number, and that is also capable of reliably blocking or restricting two undesired fluids having different density, for all flow rates once the volume fraction of the unwanted fluid exceeds a pre-defined limit. The valve 1 has very few movable parts and operates in response to phase split, i.e. volume fractions of desired and undesired fluids flowing through the valve 1.

Embodiments of the valve 1 according to the invention provides reliable re-opening mechanisms.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A valve for closing fluid communication between a horizontal or deviated well and a production string when a content of a first or a second undesired fluid in a fluid flow exceeds a predetermined level, the valve comprising:

a piston housing;

a flow barrier inside the housing;

a primary flow channel having a primary inlet through the flow barrier, and a primary outlet; and a piston arrangement movable within the piston housing between an inactive position allowing fluid flow through the primary flow channel and an active position preventing fluid flow through the primary flow channel, wherein the valve further comprises:

a secondary flow channel in connection with the primary flow channel, the secondary flow channel having two separate flow paths, each flow path having an inlet through the flow barrier, wherein each flow path of the secondary flow channel is configured for providing a pressure towards the inactive position of the piston arrangement when fluid flows through the secondary flow channel;

a bypass flow channel having two inlets through the flow barrier, and a bypass flow channel outlet, the bypass flow channel being configured for providing a pressure towards the active position of the piston arrangement when fluid flows through the bypass flow channel;

two inflow control elements for being exposed to the fluid flow upstream of the flow barrier and having different density and being movable within two independent paths between the inlets in response to a density of fluid, wherein a first of the two inflow control elements has a density between a density of a desired fluid and the density of the first undesired fluid, and a second of the two inflow control elements has a density between the density of the desired fluid and the density of the second undesired fluid;

wherein the secondary flow channel is open and the bypass flow channel is closed when an amount of one of the first and the second undesired fluid is below the predetermined level, and the piston arrangement is in the inactive position, and wherein, when one of the first and the second undesired fluid exceeds the predetermined level, the inflow control elements are caused to move within their respective paths for closing the secondary flow channel at one of its inlets and for opening the bypass flow channel at one of its inlets, and said opening and closing causing a change in pressure balance within the piston arrangement thereby moving the piston arrangement to the active position wherein the primary flow channel is closed.

2. The valve according to claim 1, wherein the primary inlet is provided with a tube having at least one tube inlet arranged between one of the inlets of the secondary flow channel and the bypass flow channel and the other of the inlets of the secondary flow channel and the bypass flow channel.

3. The valve according to claim 1, wherein the piston arrangement is axially movable within a portion of an annulus defined by:

an inner tubular body for being in fluid communication with the production string;

a housing arranged coaxially with and surrounding a portion of the inner tubular body;

a downstream barrier arranged within the annulus and axially spaced apart from the flow barrier;

wherein the annulus further comprises a stationary valve seat arranged between the downstream barrier and the flow barrier so that the a portion of the piston arrangement abuts the valve seat when the piston arrangement is in its active position and the piston arrangement does not abut the valve seat when the piston arrangement is in its inactive position.

4. The valve according to claim 3, wherein the valve seat comprises a first valve seat element and a second valve seat element axially spaced apart from the first valve seat element, a portion of the piston arrangement being movable between the valve seat elements, said portion abutting both valve seat elements when the piston arrangement is in its active position.

5. The valve according to claim 1, wherein the valve is provided with at least one leakage channel being in fluid communication with the bypass flow channel outlet for allowing leakage through the valve when the piston arrangement is in its active position.

6. The valve according to claim 5, wherein the at least one leakage channel comprises a first leakage channel and a second leakage channel being in fluid communication with the first leakage channel via a conduit.

7. The valve according to claim 1, wherein the piston arrangement comprises:

a first piston for defining a first piston chamber and a second piston chamber;

a second piston for defining a third piston chamber and a fourth piston chamber, wherein the first and second pistons are interconnected by a connection means.

8. The valve according to claim 7, wherein:

the secondary flow channel first inlet is in fluid communication with the first piston chamber;

the secondary flow channel second inlet is in fluid communication with the third piston chamber, the first piston chamber and the third piston chamber being in fluid communication with the primary flow channel;

the bypass flow channel first inlet and the bypass flow channel second inlet are in fluid communication with the second piston chamber and the fourth piston chamber, and wherein the second piston chamber and the fourth piston chamber are in fluid communication with the bypass flow channel outlet.

9. A completion string comprising a valve for closing fluid communication between a horizontal or deviated well and a production string when a content of a first or a second undesired fluid in a fluid flow exceeds a predetermined level, the valve comprising:

a piston housing;

a flow barrier inside the housing;

a primary flow channel having a primary inlet through the flow barrier, and a primary outlet; and a piston arrangement movable within the piston housing between an inactive position allowing fluid flow through the primary flow channel and an active position preventing fluid flow through the primary flow channel, wherein the valve further comprises:

a secondary flow channel in connection with the primary flow channel, the secondary flow channel having two separate flow paths, each flow path having an inlet through the flow barrier, wherein each flow path of the secondary flow channel is configured for providing a pressure towards the inactive position of the piston arrangement when fluid flows through the secondary flow channel;

a bypass flow channel having two inlets through the flow barrier, and a bypass flow channel outlet, the bypass flow channel being configured for providing a pressure towards the active position of the piston arrangement when fluid flows through the bypass flow channel;

two inflow control elements for being exposed to the fluid flow upstream of the flow barrier and having different density and being movable within two independent paths between the inlets in response to a density of fluid, wherein a first of the two inflow control elements has a density between a density of a desired fluid and the density of the first undesired fluid, and a second of the two inflow control elements has a density between the density of the desired fluid and the density of the second undesired fluid;

wherein the secondary flow channel is open and the bypass flow channel is closed when an amount of one of the first and the second undesired fluid is below the predetermined level, and the piston arrangement is in the inactive position, and wherein, when one of the first and the second undesired fluid exceeds the predetermined level, the inflow control elements are caused to move within their respective paths for closing the secondary flow channel at one of its inlets and for opening the bypass flow channel at one of its inlets, and said opening and closing causing a change in pressure balance within the piston arrangement thereby moving the piston arrangement to the active position wherein the primary flow channel is closed.

10. A method for controlling fluid flow in, into, or out of a well, wherein the method comprises the steps of:

mounting at least one valve as part of a well completion string prior to inserting the string in the well, the valve comprising:

a piston housing;

a flow barrier inside the housing;

a primary flow channel having a primary inlet through the flow barrier, and a primary outlet; and a piston arrangement movable within the piston housing between an inactive position allowing fluid flow through the primary flow channel and an active position preventing fluid flow through the primary flow channel, wherein the valve further comprises:

a secondary flow channel in connection with the primary flow channel, the secondary flow channel having two separate flow paths, each flow path having an inlet through the flow barrier, wherein each flow path of the secondary flow channel is configured for providing a pressure towards the inactive position of the piston arrangement when fluid flows through the secondary flow channel;

a bypass flow channel having two inlets through the flow barrier, and a bypass flow channel outlet, the bypass flow channel being configured for providing a pressure towards the active position of the piston arrangement when fluid flows through the bypass flow channel;

two inflow control elements for being exposed to the fluid flow upstream of the flow barrier and having different density and being movable within two independent paths between the inlets in response to a density of fluid, wherein a first of the two inflow control elements has a density between a density of a desired fluid and the density of the first undesired fluid, and a second of the two inflow control elements has a density between the density of the desired fluid and the density of the second undesired fluid;

wherein the secondary flow channel is open and the bypass flow channel is closed when an amount of one of the first and the second undesired fluid is below the predetermined level, and the piston arrangement is in the inactive position, and wherein, when one of the first and the second undesired fluid exceeds the predetermined level, the inflow control elements are caused to move within their respective paths for closing the secondary flow channel at one of its inlets and for opening the bypass flow channel at one of its inlets, and said opening and closing causing a change in pressure balance within the piston arrangement thereby moving the piston arrangement to the active position wherein the primary flow channel is closed;

bringing the well completion string into the well;

orienting the at least one valve within the well; and flowing fluid out of the well.

* * * * *